US010966526B2

(12) United States Patent
Garland

(10) Patent No.: US 10,966,526 B2
(45) Date of Patent: Apr. 6, 2021

(54) RECLINING CHAIR

(71) Applicant: American Leather Operations, LLC, Dallas, TX (US)

(72) Inventor: Thomas A. Garland, Bradenton, FL (US)

(73) Assignee: American Leather Operations, LLC, Dallas, TX (US)

( * ) Notice: Subject to any disclaimer, the term of this patent is extended or adjusted under 35 U.S.C. 154(b) by 127 days.

(21) Appl. No.: 16/373,993

(22) Filed: Apr. 3, 2019

(65) Prior Publication Data

US 2019/0223599 A1 Jul. 25, 2019

Related U.S. Application Data

(60) Division of application No. 15/342,154, filed on Nov. 3, 2016, now Pat. No. 10,251,484, which is a (Continued)

(51) Int. Cl.
*A47C 1/032* (2006.01)
*A47C 1/034* (2006.01)
(Continued)

(52) U.S. Cl.
CPC ..... *A47C 1/032* (2013.01); *A47C 1/024* (2013.01); *A47C 1/034* (2013.01); *A47C 1/0342* (2013.01);
(Continued)

(58) Field of Classification Search
CPC ..... A47C 1/03261; A47C 1/032; A47C 1/024; A47C 1/034; A47C 1/0355; A47C 7/5068; A47C 7/506; A47C 1/0345; A47C 1/0342
(Continued)

(56) References Cited

U.S. PATENT DOCUMENTS 2,914,114 A 11/1959 Fletcher
2,966,939 A 1/1961 Fletcher
(Continued)

FOREIGN PATENT DOCUMENTS

CN 2168480 Y 6/1994
CN 2246209 Y 1/1997
(Continued)

OTHER PUBLICATIONS

Notification of Transmittal of the International Search Report and Written Opinion of the International Searching Authority, or the Declaration; PCT/US2012/31231, dated Jun. 27, 2012, 17 pgs.
(Continued)

*Primary Examiner* — Milton Nelson, Jr.
(74) *Attorney, Agent, or Firm* — Wombl Bond Dickinson (US) LLP

(57) ABSTRACT

Furniture is described having an extendable footrest. The footrest has a main panel and a flipper panel. In an extended position of the footrest, the top surfaces of the panels are approximately horizontal and co-planar, the main panel being proximate to a seat portion of the furniture. In a retracted position of the footrest, the top surface of the main panel is approximately vertical and the top surface of the flipper panel is approximately horizontal and facing in a downward direction. The footrest projects substantially 20" or more from the front of the seat portion in the extended position, and substantially 7" or less is provided between the floor and the apparent bottom edge of the footrest when retracted.

19 Claims, 22 Drawing Sheets

Related U.S. Application Data continuation of application No. 14/509,114, filed on Oct. 8, 2014, now Pat. No. 9,504,328, which is a division of application No. 13/435,252, filed on Mar. 30, 2012, now Pat. No. 8,882,190.

(60) Provisional application No. 61/516,134, filed on Mar. 30, 2011.

(51) Int. Cl.
*A47C 1/0355* (2013.01)
*A47C 7/50* (2006.01)
*A47C 1/024* (2006.01)

(52) U.S. Cl.
CPC ..... *A47C 1/0345* (2013.01); *A47C 1/0355* (2013.01); *A47C 1/03261* (2013.01); *A47C 7/506* (2013.01); *A47C 7/5068* (2018.08)

(58) Field of Classification Search
USPC ..... 297/301.7, 301.6, 423.26, 423.21
See application file for complete search history.

(56) References Cited

U.S. PATENT DOCUMENTS

| | | | |
|---|---|---|---|
| 2,973,027 | A | 2/1961 | Navelle et al. |
| 3,100,668 | A | 8/1963 | Rogers et al. |
| 3,295,885 | A | 1/1967 | Barksdale |
| 3,370,884 | A | 2/1968 | Rogers |
| 3,400,975 | A | 9/1968 | Rogers |
| 3,494,660 | A | 2/1970 | Caldemeyer et al. |
| 3,537,747 | A | 11/1970 | Rogers |
| 3,652,125 | A | 3/1972 | Rogers |
| 3,730,585 | A | 5/1973 | Rogers et al. |
| 3,743,348 | A | 7/1973 | Sloan |
| 3,767,257 | A | 10/1973 | Snitzer et al. |
| 3,768,859 | A | 10/1973 | Rogers et al. |
| 3,781,060 | A | 12/1973 | Pentzien |
| 3,815,954 | A | 6/1974 | Rogers et al. |
| 3,865,432 | A | 2/1975 | Rogers et al. |
| 3,869,169 | A | 3/1975 | Johnson et al. |
| 3,904,240 | A | 9/1975 | Rogers |
| 4,071,275 | A | 1/1978 | Rogers |
| 4,108,491 | A | 8/1978 | Rogers |
| 4,185,869 | A | 1/1980 | Rogers |
| 4,188,062 | A | 2/1980 | Rogers et al. |
| 4,226,469 | A | 10/1980 | Rogers et al. |
| 4,249,772 | A | 2/1981 | Rogers |
| 4,291,913 | A | 9/1981 | Kowalski |
| 4,337,977 | A | 7/1982 | Rogers et al. |
| 4,350,386 | A | 9/1982 | Rogers |
| 4,350,387 | A | 9/1982 | Rogers |
| 4,352,523 | A | 10/1982 | Holobaugh |
| 4,357,049 | A | 11/1982 | Rogers et al. |
| 4,396,226 | A | 8/1983 | Haack |
| 4,418,957 | A | 12/1983 | Rogers |
| 4,509,795 | A | 4/1985 | Brennan et al. |
| 4,570,995 | A | 2/1986 | Rogers |
| 4,669,778 | A | 6/1987 | Rogers |
| 4,678,229 | A | 7/1987 | Ryan et al. |
| 4,740,031 | A | 4/1988 | Rogers |
| 4,805,960 | A | 2/1989 | Tacker |
| 4,819,987 | A | 4/1989 | Stringer |
| 4,877,291 | A | 10/1989 | Taylor |
| 4,894,876 | A | 1/1990 | Fenwick |
| 4,915,444 | A | 4/1990 | Rogers |
| 5,072,988 | A | 12/1991 | Plunk |
| 5,121,967 | A | 6/1992 | Rogers |
| 5,129,701 | A | 7/1992 | Pine |
| 5,156,441 | A | 10/1992 | Byersmith et al. |
| 5,192,113 | A | 3/1993 | Wiecek |
| 5,326,153 | A | 7/1994 | Muffi |
| 5,352,020 | A | 10/1994 | Wade et al. |
| 5,354,116 | A | 10/1994 | May et al. |
| 5,419,611 | A | 5/1995 | Cook |
| 5,423,591 | A | 6/1995 | LaPointe et al. |
| 5,645,313 | A | 7/1997 | Best et al. |
| 5,795,021 | A | 8/1998 | Rogers |
| 5,868,461 | A | 2/1999 | Brotherston |
| 5,954,392 | A | 9/1999 | Liss et al. |
| 5,971,475 | A | 10/1999 | Lawson et al. |
| 5,975,627 | A | 11/1999 | LaPointe et al. |
| 5,992,930 | A | 11/1999 | LaPointe et al. |
| 6,120,095 | A | 9/2000 | Rogers |
| 6,312,054 | B1 | 11/2001 | Scheurer et al. |
| 6,318,803 | B1 | 11/2001 | Garland |
| 6,409,262 | B1 | 6/2002 | LaPointe |
| 6,655,732 | B1 | 12/2003 | LaPointe |
| 6,733,071 | B2 | 5/2004 | Guillot et al. |
| 6,902,238 | B1 | 6/2005 | Abt et al. |
| 7,114,770 | B2 | 10/2006 | Murphy |
| 7,134,713 | B1 | 11/2006 | Tseng |
| D532,984 | S | 12/2006 | Bernett |
| D534,734 | S | 1/2007 | Bernett |
| 7,261,367 | B2 | 8/2007 | Duncan et al. |
| 7,475,944 | B2 | 1/2009 | Griepentrog et al. |
| 7,543,893 | B2 | 6/2009 | LaPointe |
| 7,585,018 | B2 | 9/2009 | LaPointe et al. |
| 7,600,817 | B2 | 10/2009 | Kramer et al. |
| 7,823,966 | B2 | 11/2010 | Buchholz |
| 7,850,237 | B2 | 12/2010 | Gorgi |
| 7,866,755 | B2 | 1/2011 | Okano |
| 7,971,936 | B2 * | 7/2011 | Fukai ..... A47C 1/032 297/320 |
| 7,997,644 | B2 | 8/2011 | Hoffman et al. |
| 8,016,348 | B2 | 9/2011 | Hoffman et al. |
| 8,297,693 | B2 | 10/2012 | Hoffman et al. |
| 8,444,225 | B2 | 5/2013 | Behe |
| 8,444,226 | B2 | 5/2013 | Driessen et al. |
| 8,573,687 | B2 | 11/2013 | Lawson et al. |
| 8,622,467 | B2 | 1/2014 | Murphy et al. |
| 8,882,190 | B2 | 11/2014 | Garland |
| 9,504,328 | B2 | 11/2016 | Garland |
| 10,251,484 | B2 | 4/2019 | Garland |
| 2002/0135212 | A1 | 9/2002 | Kain |
| 2003/0172455 | A1 * | 9/2003 | Roma ..... A47C 17/1753 5/37.1 |
| 2006/0265630 | A1 | 11/2006 | Tseng |
| 2007/0158980 | A1 | 7/2007 | LaPointe et al. |
| 2007/0241589 | A1 | 10/2007 | LaPointe |
| 2007/0252422 | A1 | 11/2007 | Beaver et al. |
| 2007/0278837 | A1 | 12/2007 | White et al. |
| 2008/0012397 | A1 | 1/2008 | Buchholz |
| 2008/0111402 | A1 | 5/2008 | Crum |
| 2009/0315376 | A1 | 12/2009 | Nishiwaki |
| 2010/0190623 | A1 | 7/2010 | Guissin et al. |
| 2016/0029800 | A1 | 2/2016 | Bryant |

FOREIGN PATENT DOCUMENTS

| | | |
|---|---|---|
| CN | 100376186 | 3/2008 |
| CN | 101142119 | 3/2008 |
| CN | 101163424 | 4/2008 |
| CN | 201175153 Y | 1/2009 |
| CN | 101410036 | 4/2009 |
| CN | 101511229 | 8/2009 |
| WO | 2006054064 A1 | 5/2006 |
| WO | 2006114250 A1 | 11/2006 |

OTHER PUBLICATIONS

Chinese Office Action for App. No. 201280015832.X, dated Mar. 31, 2015, 13 pgs.

* cited by examiner

RECLINING CHAIR

RELATED APPLICATIONS

This application is a divisional of U.S. patent application Ser. No. 15/342,154, filed Nov. 3, 2016, now U.S. Pat. No. 10,251,484, which is a continuation of U.S. patent application Ser. No. 14/509,114, filed Oct. 8, 2014, now U.S. Pat. No. 9,504,328, which is a divisional of U.S. patent application Ser. No. 13/435,252, filed Mar. 30, 2012, now U.S. Pat. No. 8,882,190, which claimed the benefit of U.S. Provisional Patent Application Ser. No. 61/516,134, filed Mar. 30, 2011, all of which are entirely incorporated herein by reference.

TECHNICAL FIELD

The present invention relates to furniture, and more particularly to reclining chairs.

SUMMARY OF THE EMBODIMENTS

A first embodiment of the invention is a chair. As used herein, the term "chair" includes any piece of furniture similar to a chair, such as a section of a sofa. The chair has a seat portion having a front, a rear and sides. The chair also has a footrest adjustable between at least two positions: a retracted position and an extended position. The footrest is cantilevered from the seat portion in the extended position. The chair also has a plurality of members connected by a plurality of linkages permitting the members to pivot with respect to each other. The plurality of members is adapted to hold the footrest in the retracted position and to support the footrest in the extended position. The chair also has a cover for hiding the plurality of linkages when viewed from a lateral position when the footrest is in the extended position.

In a related embodiment, the footrest includes a main panel and a flipper panel adjacent to the main panel. The flipper panel forms a panel angle with the main panel. The plurality of members causes the panel angle to increase from when the footrest is in the retracted position to when the footrest is in the extended position.

In a further related embodiment, the chair also includes a backrest adjacent the rear of the seat portion and extending from the seat portion at a backrest angle. The backrest angle is adjustable independently of the footrest position.

In a further related embodiment, the chair also includes a friction plate located adjacent a pivot point for the backrest, a compression spring adjacent the friction plate, and a knob adjacent the compression spring. The knob may be adjusted to change the amount of force required to change the angle of the backrest.

In a further related embodiment, the chair also includes lateral walls connected to the sides of the seat portion, and a second plurality of members connected to each other and to the plurality of members with a second plurality of linkages. The lateral walls hide the second plurality of members when viewed from a lateral position when the footrest is in the extended position.

Another embodiment is a chair having a seat portion including a front, a rear and sides. The chair also includes a footrest adjustable between at least two positions: a retracted position and an extended position. The footrest is cantilevered from the seat portion in the extended position. The chair also includes at least one member adapted to move the footrest between the retracted position and the extended position. The chair also includes a gas cylinder having a valve. The gas cylinder is connected to the at least one member. When the valve is closed, the gas cylinder locks the at least one member and the footrest in position, and when the valve is open, the gas cylinder permits movement of the at least one member and the footrest.

In a related embodiment, the at least one member is one of a plurality of members collectively adapted to move the footrest between the retracted position and the extended position.

Another embodiment is a chair having a seat portion having a front, a rear and sides, and a backrest extending from the seat portion at an angle. The angle of the backrest is adjustable. The chair also includes a friction plate located adjacent a pivot point for the backrest. The chair also includes a compression spring adjacent the friction plate and a knob adjacent the compression spring. The knob may be adjusted to change the amount of force required to change the angle of the backrest. The chair also includes a spring connected to the backrest. The spring is neutral when the angle of the backrest is between an upright position and an intermediate position. The spring provides resistance to movement of the backrest toward a fully reclined position when the angle of the backrest is between the intermediate position and the fully reclined position.

In a related embodiment, the chair further includes a linkage member connected to the backrest. The linkage member limits motion of the compression spring relative to the friction plate between a first position and a second position. The compression spring is in the first position when the backrest is in the upright position. The compression spring travels to the second position when the backrest moves from the upright position to the intermediate position.

Another embodiment is a chair having a support structure and a seat portion. The seat portion is mounted on the support structure and defines an approximately horizontal plane. The chair also includes a reclinable backrest mounted on the support structure. The backrest is movable between an approximately vertical position and a reclined position. The chair also includes a footrest adjustable between a retracted position and an extended position. The footrest and the backrest define fore and aft directions relative to the seat. The footrest has first and second segments. Each segment has an edge approximately contiguous with an edge of the other segment and also has a top surface. In the extended position of the footrest the top surfaces of the segments are approximately horizontal and co-planar, and the first segment is proximate to the seat portion. In the retracted position of the footrest, the top surface of the first segment is approximately vertical and the top surface of the second segment is approximately horizontal and facing in a downward direction. The footrest is supported by a cantilever assembly including a pair of long linkages. Each long linkage is mounted to the support structure near a first end of the long linkage by a pair of approximately parallel support linkages, so that the long linkages are disposed in a generally horizontal plane and are movable in fore and aft directions. The cantilever assembly further includes first and second pairs of footrest linkages. Each one of the first pair of footrest linkages is coupled at a first end to a second end of a corresponding one of the long linkages and each one of the second pair of footrest linkages is coupled to a second end of a corresponding one of the first pair of footrest linkages. The first pair of footrest linkages thus supports the first footrest segment and the second pair of footrest linkages support the second footrest segment. The chair also includes a pair of footrest deployment modules. Each module includes a force transmission train that is disposed adjacent to and along one of the long linkages. The long linkages are disposed entirely beneath the seat portion and the cantilever assembly occupies a vertically compact space that is approximately defined in height by the length of the support linkages.

Another embodiment is a chair having a support structure and a seat portion mounted on the support structure and defining an approximately horizontal plane. The chair includes a reclinable backrest mounted on the support structure and movable between an approximately vertical position and a reclined position. The chair also includes a footrest adjustable between a retracted position and an extended position. The footrest and the backrest define fore and aft directions relative to the seat. The chair also includes a gas cylinder having (i) a first end coupled to a component of the chair distinct from the footrest, (ii) a second end coupled to the footrest and (iii) a valve, the first and second ends of the gas cylinder having an adjustable spacing therebetween when the valve is open and a substantially fixed spacing therebetween when the valve is closed. An actuator (e.g., a lever) is configured in relation to the footrest and the support structure to enable locking of the footrest in a desired position between, and including, the retracted position and the extended position. The actuator is movably coupled to the support structure and is also coupled to the valve. The actuator has a first position wherein the valve is closed, a second position wherein (i) the valve is open and (ii) the actuator engages a member, coupled to the footrest and configured to urge the footrest toward the extended position when the footrest is in the retracted position. The actuator is spring-biased to the first position. Moving the actuator to the second position urges the footrest toward the extended position and releasing the actuator when the footrest reaches the desired position causes locking of the footrest in that position.

In a related embodiment, the actuator includes, between the first and second positions, an intermediate position wherein the valve is open but the actuator has not engaged the member. In a related embodiment, the component to which the cylinder's first end is coupled is the seat portion, and wherein the seat portion is mounted in relation to the backrest to move forward when the backrest is reclined, and so that when the seat portion moves forward the footrest, which is coupled thereto through the gas cylinder, also moves forward.

Another embodiment is a chair having a seat portion and a footrest, the footrest being adjustable between at least two positions: a retracted position and an extended position. The chair also includes a mounting member, which is connected to the seat portion, and a primary support member, which supports the footrest. A mounting am is pivotally connected to the mounting member and pivotally connected to the primary support me liter, so that the primary support member is swingable with respect to the mounting member. The chair also includes an actuating linking member, which is pivotally connected to the mounting member, and an intermediate linking member, which is pivotally connected to the actuating linking member and pivotally connected to the mounting arm, so that when the actuating linking member is pivoted a force is transmitted to the mounting arm. The chair further includes a force applicator coupled to the actuating linking member. The force applicator has a lock mode and a force mode, wherein in the lock mode the force applicator locks the actuating linking member and the footrest in position, and in the fore mode the force applicator applies a force to the actuating linking member so as to cause the actuating linking member to pivot and urge the footrest to the extended position.

In a related embodiment, the chair further includes a secondary arm pivotally connected to the mounting member and pivotally connected to the primary support member so as to control the primary support member's orientation as the primary support member swings with respect to the mounting member. In a related embodiment, the force applicator includes a gas cylinder having a valve, wherein when the valve is closed, the force applicator is in the lock mode, and when the valve is open, the force applicator is in the force mode.

In a related embodiment, the chair also includes an actuator, movably coupled to the mounting member, wherein the actuator is spring-biased to a first position, and wherein, when the actuator is urged towards a second position, the actuator engages one of the intermediate linking member, the mounting arm and the actuating linking member, so that the actuator urges the footrest toward the extended position. In a further related embodiment, the actuator is coupled to the force applicator and causes the force applicator to switch between the lock mode and the force mode.

Another embodiment is chair having a support structure; a seat portion, mounted on the support structure and defining an approximately horizontal plane; a reclinable backrest mounted on the support structure, movable between an approximately vertical position and a reclined position; a footrest adjustable between a retracted position and an extended position. The footrest and the backrest define fore and aft directions relative to the seat. The footrest has first and second segments, and each segment has an edge approximately contiguous with an edge of the other segment and also has a top surface. In the extended position of the footrest, the top surfaces of the segments are approximately horizontal and co-planar, the first segment being proximate to the seat portion. In the retracted position of the footrest, the top surface of the first segment is approximately vertical and the top surface of the second segment is approximately horizontal and facing in a downward direction. The chair also includes a cantilever assembly supporting the footrest by including a pair of long linkages, each long linkage mounted, near a first end thereof, by a pair of approximately parallel support linkages, to the support structure, so that the long linkages are disposed in a generally horizontal plane and are movable in fore and aft directions; first and second pairs of footrest linkages, connected to the cantilever assembly, wherein each one the first pair of footrest linkages is coupled at first end to a second end of a corresponding one of the long linkages and each one of the second pair of footrest linkages is coupled to a second end of a corresponding one of the first pair of footrest linkages; and so that the first pair of footrest linkages support the first footrest segment and the second pair of footrest linkages support the second footrest segment; and a pair of footrest deployment modules, each module including a force transmission train that is disposed adjacent to and along one of the long linkages. When the footrest is in the extended position, the cantilever assembly occupies an extended-position vertically compact space that, at each point between the front of the seat portion and the first segment, is defined approximately by the long linkages.

In a related embodiment, when the footrest of the chair is in the retracted position, the long linkages are disposed entirely beneath the seat portion and the cantilever assembly occupies a retracted-position vertically compact space that is approximately defined in height by the length of the support linkages.

Another embodiment is a chair having a stationary frame which includes a stationary base, a post resting on the stationary base, a base plate fixedly mounted on a top end of the post, such that the base plate is pivotable with respect to the stationary base, and a chassis fixedly mounted to the base plate and to a right and left arm rest mounting frame. Each arm rest has a knob located near a front portion and an anchor located near a back portion. Each knob movably engages in a slot of a mounting plate connected to the frame of a reclining mechanism, and the anchor movably supporting a backrest plate, a backrest connected to the backrest plate. The reclining mechanism includes a footrest assembly, a backrest assembly, and a seat frame movably connected to the footrest assembly and the backrest and is suspended in relation to the stationary frame to the knobs and anchors. The deployment of the footrest assembly from a closed position to an extended position is independent of the reclining of the backrest from an upright position to a reclined position. Further, the seat frame along with the footrest assembly moves upward and forward when the backrest assembly is reclined.

BRIEF DESCRIPTION OF THE DRAWINGS

The foregoing features of embodiments will be more readily understood by reference to the following detailed description, taken with reference to the accompanying drawings, in which.

DETAILED DESCRIPTION OF SPECIFIC EMBODIMENTS

Figure 1A:
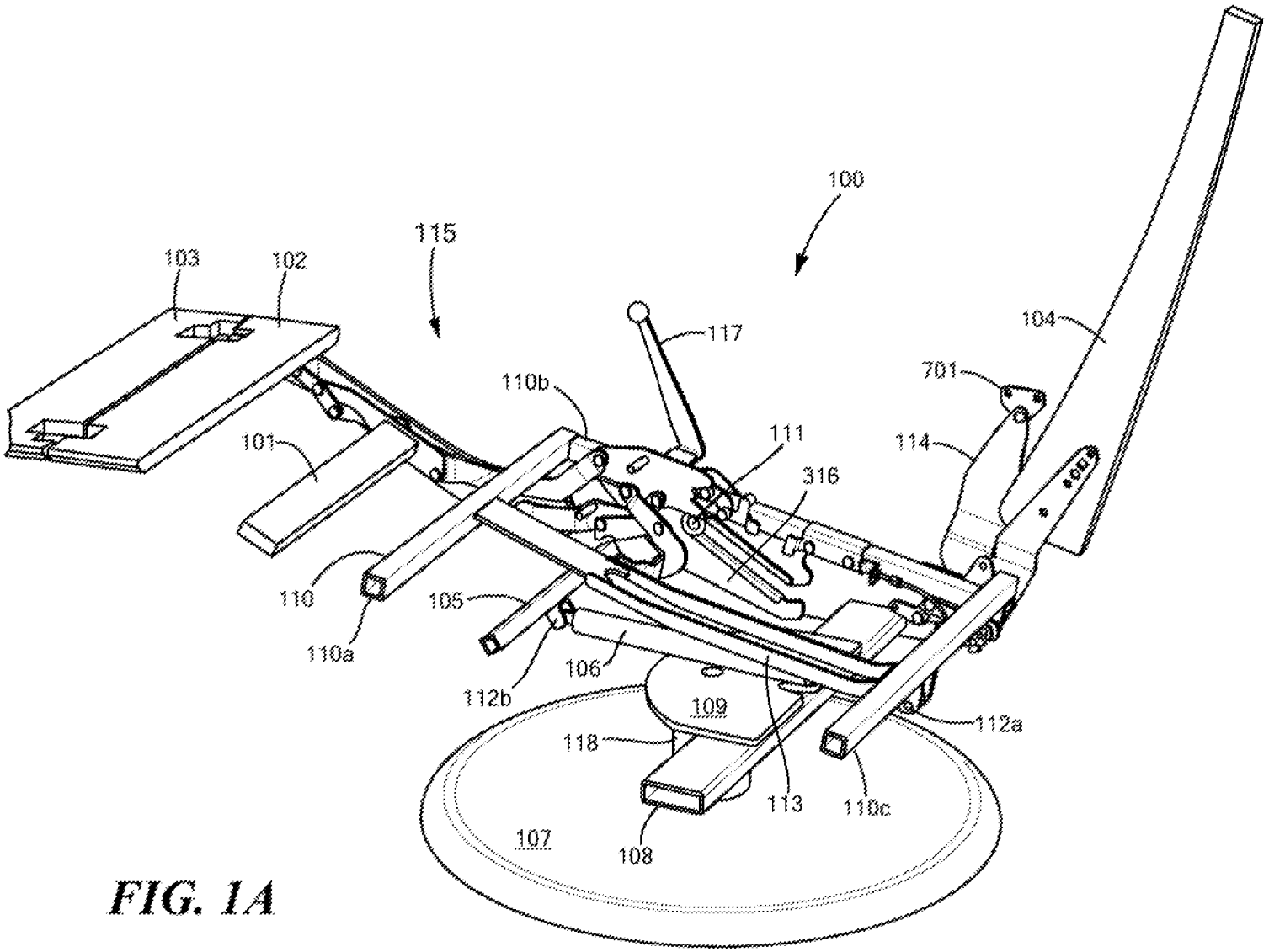
FIG. 1A is a perspective view from the side of components of a reclining chair in accordance with an embodiment of the present invention.
Figure 1B:
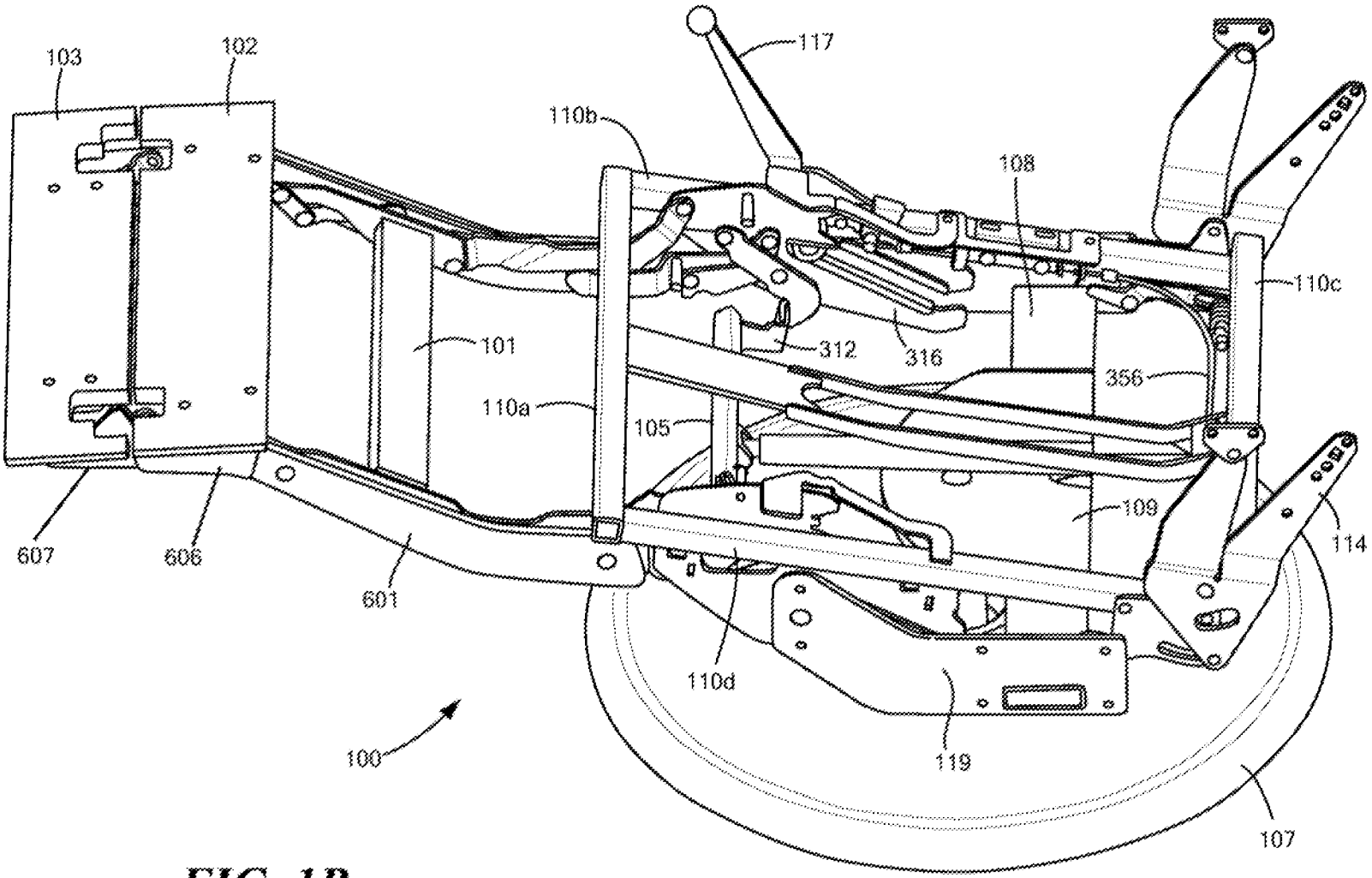
FIG. 1B is a perspective view from the top of the components of a reclining chair in accordance with an embodiment of the present invention.
Figure 2A:
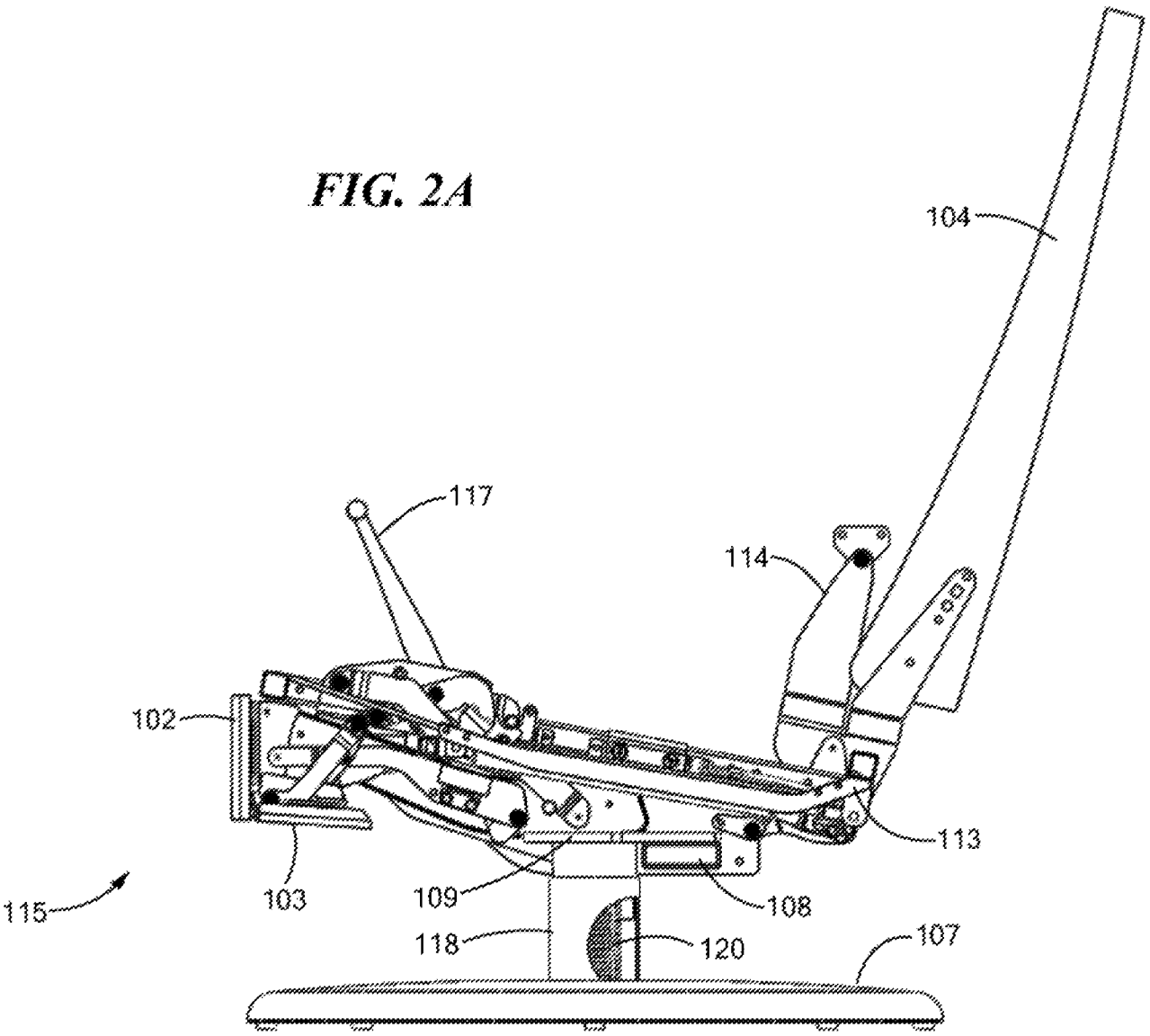
FIGS. 2A-C are side views of components of the reclining chair embodiment of FIG. 1, with each of these figures representing the reclining chair in a different position: 2A upright chair position; 2B TV position; 2C full recline position.
Figure 2B:
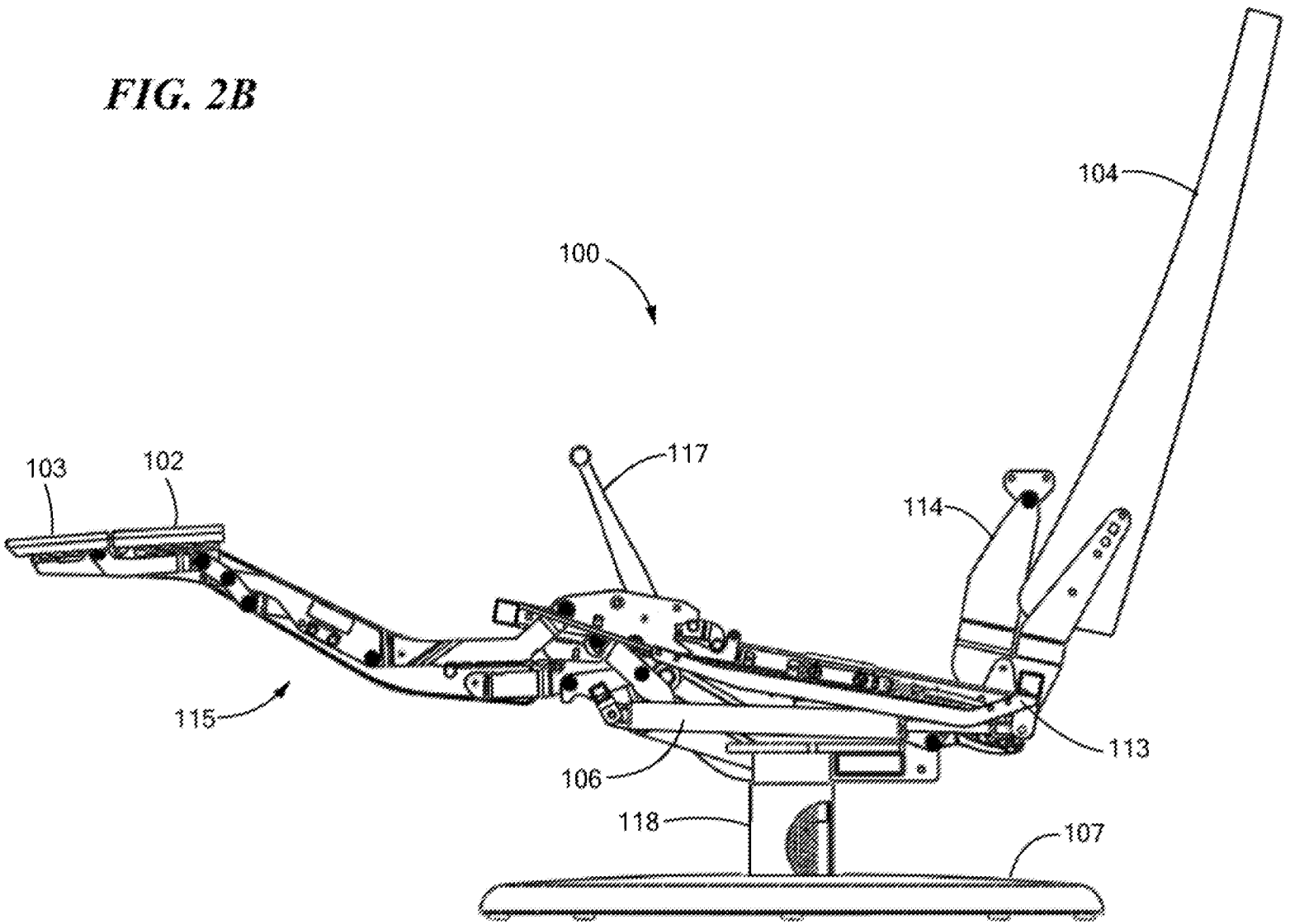
Figure 2C:
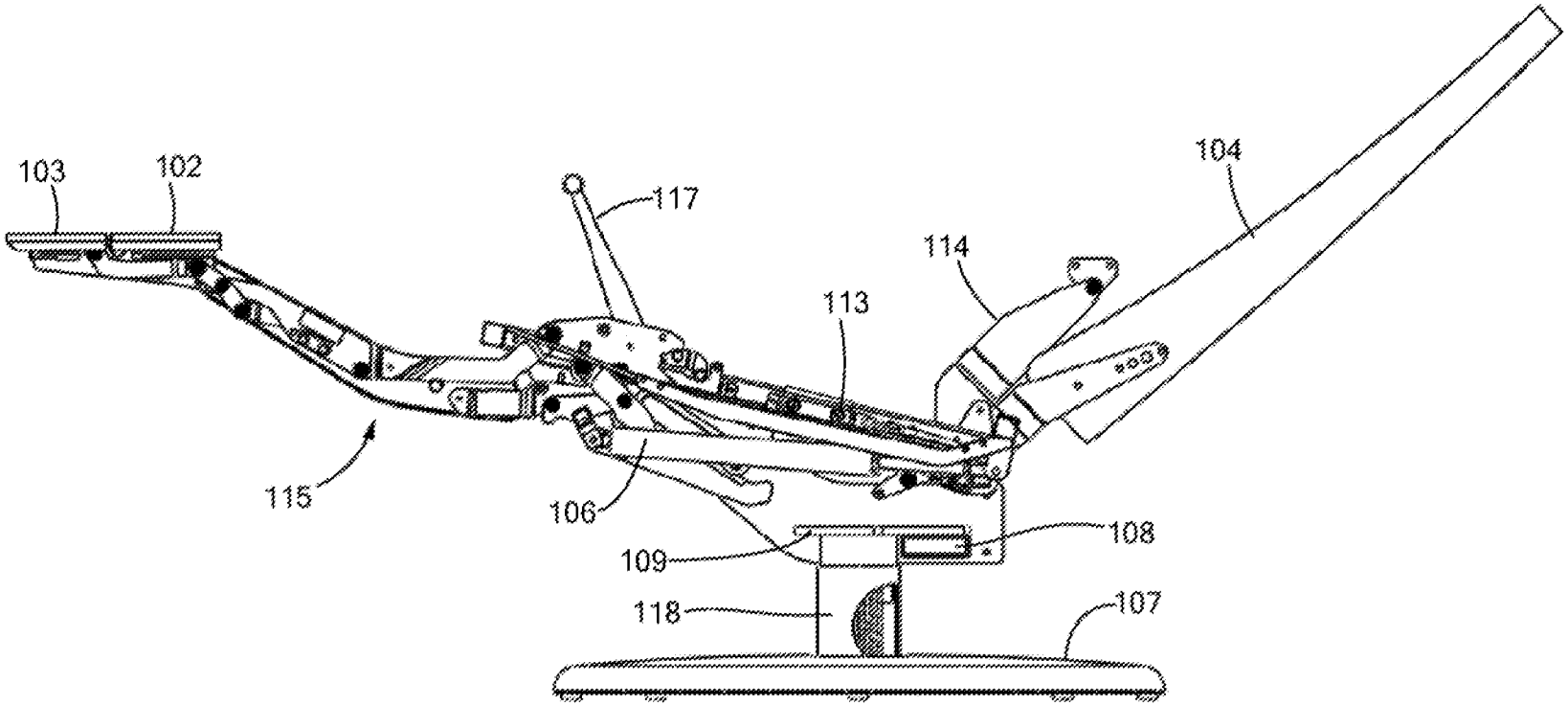

FIG. 1A snows a perspective view of some of the components of a reclining chair 100 in accordance with an embodiment of the present invention. FIG. 1B shows a perspective view from the top of both the right and left assemblies. FIG. 2A is a side view of the chair wherein the footrest is in a closed position and the backrest is in an upright position. The footrest and backrest are independently adjustable; either one may be adjusted while the other is in any position. FIG. 2B shows the footrest nifty extended, while the backrest is fully upright. FIG. 2C shows the footrest in a fully extended position while the backrest is fully inclined.

As shown in FIGS. 1A and 1B, this embodiment includes a stationary base 107 configured to sit flat and securely on the ground or floor. A rotating base 109 is rotatably coupled to the center of stationary base 107, by a pivoting post 118 supporting the chair and allowing it to swivel around the axis of rotating base 109. In some embodiments, the height of rotating base 109 relative to stationary base 107 may be adjustable, which allows the height of the seat of the chair to be varied. This may be accomplished, e.g., by a screw 120 mechanism (shown in FIG. 2A) wherein repeatedly revolving the chair around the axis of rotating base 109 in a first direction causes the height to increase, while revolving in the opposite direction causes the height to decrease. A chassis 108 is firmly coupled to rotating base 109 and to the armrest and sidewall portions 119 of the chair. The chassis is substantially symmetrical with respect to an axis of symmetry collinear with a gas cylinder 106, (the operation of the gas cylinder will be discussed later), but the sidewall portion 119 nearest the viewer has been removed from the figure for clarity in FIG. 1A. A knob 111 extends from the light side of the sidewall 119 toward the interior of the chair. A second knob is present on the left side of the sidewall 119. Frame 110 is moveably supported on the sidewalk 119 by knobs 111 traveling in slot 306 of mounting plate 316 at the front end of the chair (see FIGS. 3, 10E-10G), and at anchoring bracket 701 (see FIG. 7) at the back end of the chair.

Figure 7:
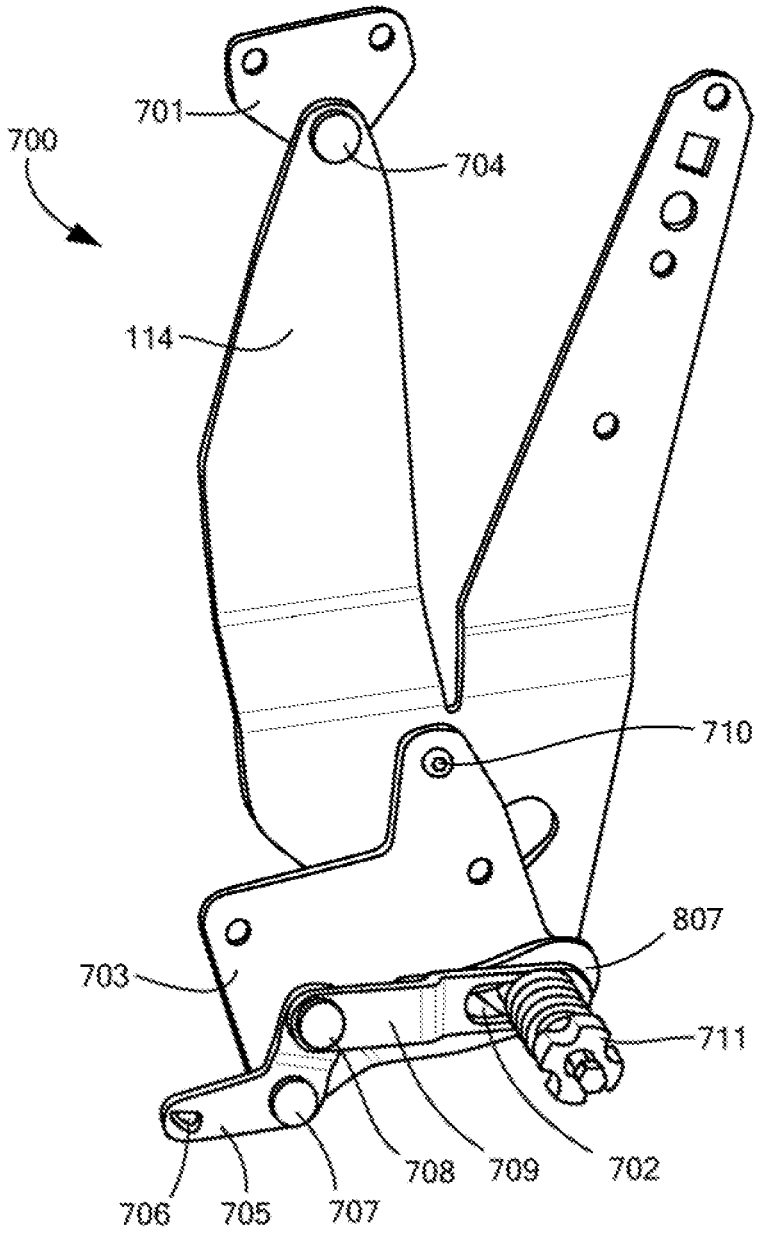
FIG. 7 is a perspective view of a mechanism in the reclining backrest of the reclining chair embodiment of FIG. 1.
Figure 8:
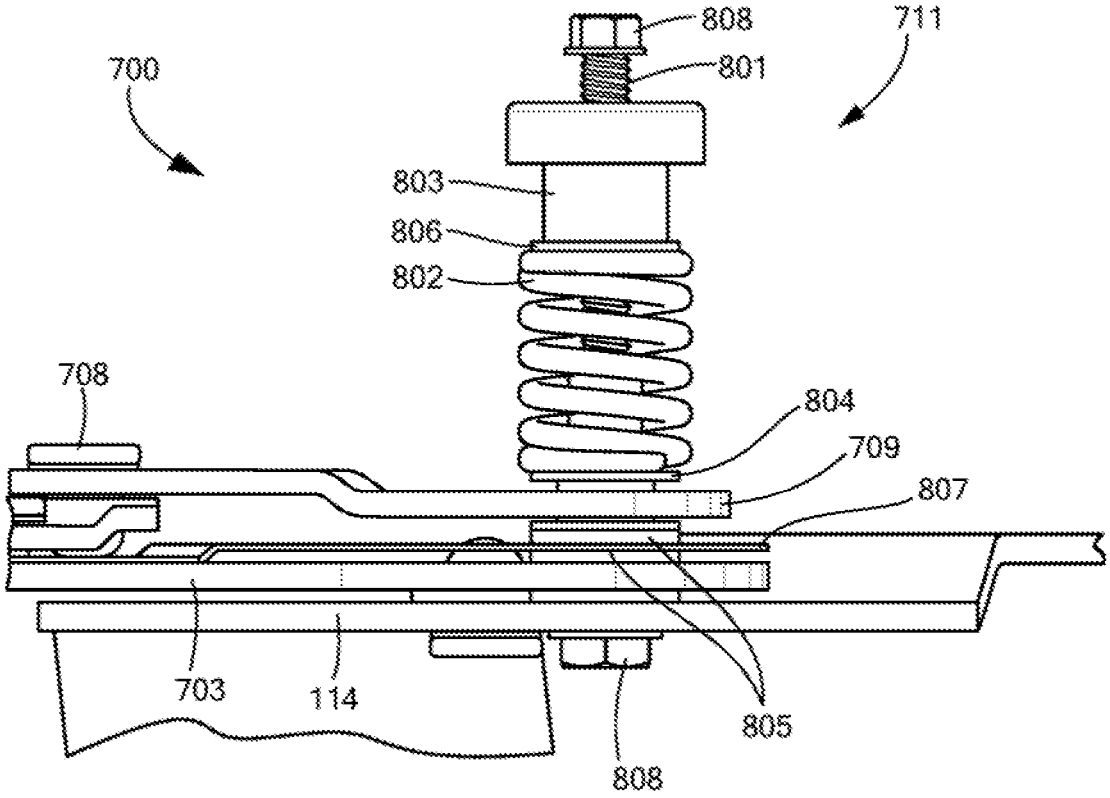
FIG. 8 is a top view of a sub-mechanism of the mechanism of FIG. 7.

A frame 110*a-d* is coupled to a backrest assembly (which will be discussed later with reference to FIGS. 7 and 8). The seat (not shown) of the chair sits on frame 110*a-d*. Three sides of the rectangular frame 110 are shown in FIG. 1A front 110*a*, right side 110*b*, backside 110*c*, and the fourth (left) side 110*d* is shown in FIG. 1B. Similarly, only one of the two backrest assemblies 700 (see FIG. 7) and only one of the two footrest assemblies 115 are shown, for clarity in FIG. 1A. FIG. 1B shows the full mechanism, with the complete chassis and frame, as well as both backrest assemblies and both footrest assemblies. The frame 110*a-d* also is coupled to the footrest assemblies (which will be discussed later with reference to FIG. 5). When the chair reclines, the seat, frame and footrest assemblies slide forward and upward. The motion of the seat, frame and footrest assemblies are governed by the relative "motion" of a knob 111 within a slot 306 in a mounting plate 316 in shown in FIG. 3. In practice, the knob 111 and sidewall portion 119 remain stationary, while the seat, frame and footrest assembly slide relative to the knob 111 and chassis 108. The frame 110*a-d* is also movably connected to the gas cylinder 106 at pivot points 112*a-b*. The frame 110 includes a slot formed by parallel support members 113 which protects the gas cylinder 106 from being damaged by the seat of the chair being pushed too far downward, while also allowing the frame 110 to sit closely on top of the gas cylinder 106 without the support members coming into direct contact with the body of the cylinder.

Figure 3:
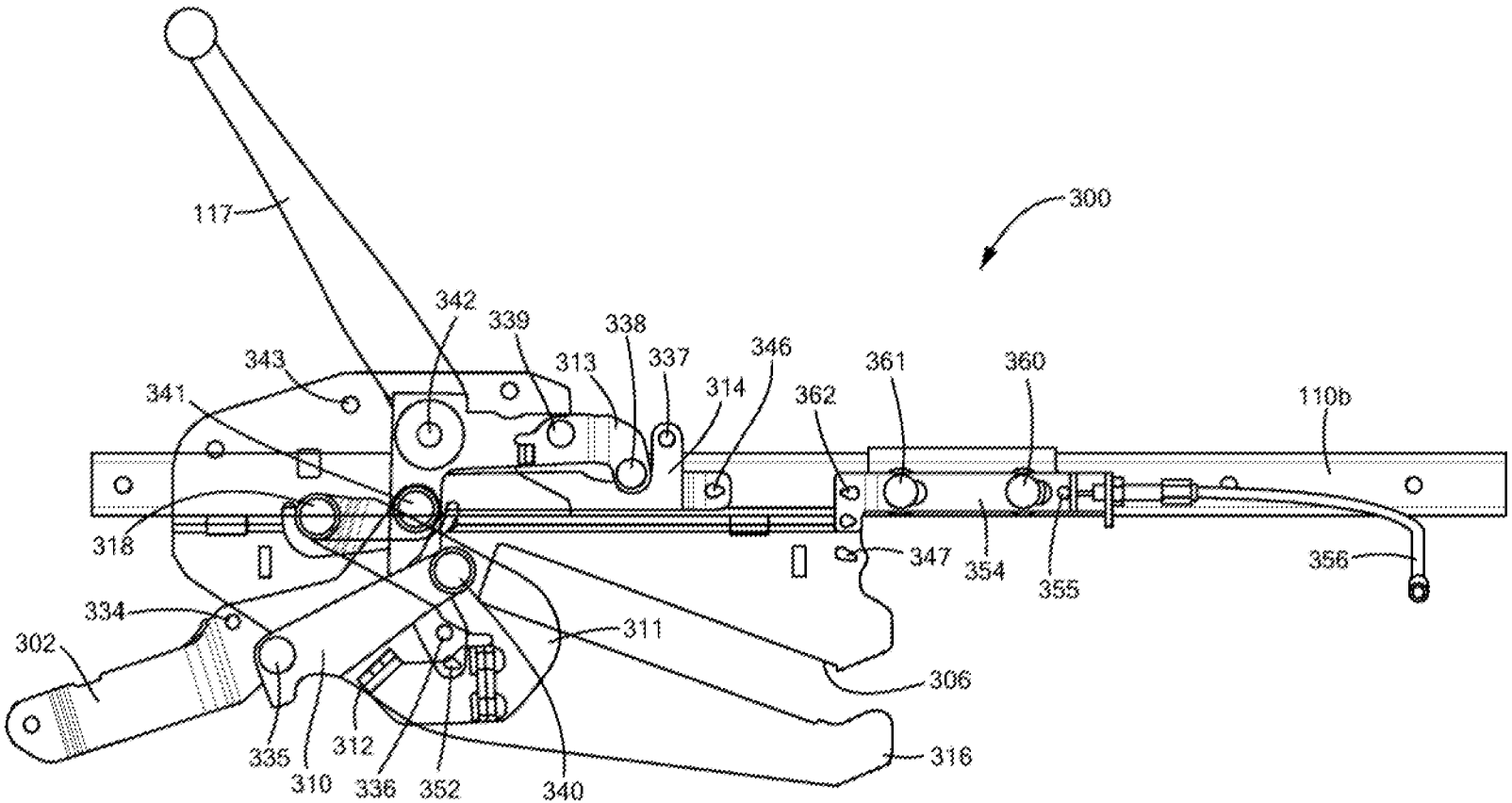
FIGS. 3 and 4 are side views of the backward portion of the mechanism for use in opening and closing the footrest of the FIG. 1 embodiment with the front portion shaded in FIG. 3.

Referring to FIG. 1B and FIG. 3, gas cylinder 106 is also connected at its second end to crossbar 105. Crossbar 105 is joining on the right and left to footrest assemblies 115 at the end 312 of linkage member 311. Crossbar 105 is connected to gas cylinder 106 at its midsection through pivot point 112*b*. When lever 117 is pulled backward toward the back rest, it releases the locking mechanism allowing the footrest assemblies to deploy forward assisted by the force exerted by the gas cylinder. The lever 117 may then be pushed back into position to lock the footrest assemblies at the desired extended position, partially to fully deployed.

Many prior art footrests tar reclining chairs project around 15"-16" forward of the front edge of the seat cushion. Given that for an occupant of the chair the back of the occupant's knee generally is at the front edge of the seat cushion, the occupant's feet often hang over the front of the footrest. Some embodiments of the present invention have been found in practice to allow for up to 20" of footrest extension in chairs of similar seat height as prior art chairs suffering from the deficiency identified above. The 16" length of extension has been a limitation in prior art chairs that derives from the space limitations under the chair which limit the length of links that can be used to create the extension. Various embodiments of the present invention have nonetheless achieved greater extension by employing a novel footrest support while using less vertical space under the chair.

One aspect of the footrest support that contributes to its ability to provide extra inches of support is the use of a two panel footrest system where there is a main footrest panel 102 and what is known as a flipper panel 103. FIG. 2A shows the orientation of these panels when the footrest is in a closed position. The main footrest panel 102 is in a generally vertical plane, while the flipper panel 103 is in a generally horizontal plane. FIG. 2B shows how the flipper panel rotates about the lower edge of the main footrest panel as the main footrest panel rotates and is elevated toward a horizontal open position shown in FIG. 2C. In the embodiment shown in FIG. 1, the flipper panel is a full-width panel having the same width as the main footrest panel and the seat cushion.

Embodiments of the present invention include a gas cylinder 106 having a sliding rod and piston that is used to quietly position the footrest 102, 103. The cylinder may be locked, preventing both extension and retraction of the sliding rod. The cylinder also may be opened, at which point the cylinder exerts a pressure tending to cause the sliding rod to extend. When the valve of cylinder is open and a sufficiently strong pressure is applied in opposition to this tendency, the sliding rod is retracted, meaning that in the case of the reclining chair, the footrest is retracted. If such oppositional pressure is not applied, the sliding rod extends, and the footrest is deployed. At any position, whether Rill extension, full retraction, or an intermediate position, the gas cylinder may be closed, thereby locking the footrest into various positions.

To open the footrest assemblies 115 from a closed position, an occupant of the chair may pull a lever 117, thereby employing two mechanisms for opening the footrest, an articulated support arm 500 (shown in FIG. 5) connected to mounting frame 300, and the concerted counteraction of a spring and gas cylinder. Regarding the first mechanism, pulling the lever translates a mechanical force to a roller pin (item 338, FIG. 3) that pushes the footrest assemblies 115 toward an open position. Regarding the second mechanism, pulling the lever 117 pulls on a cable that activates the valve of the gas cylinder 106. The various torques and thrusts (A-L) applied are discussed with reference to FIGS. 3, 9A-9C and 10A-1. In a closed position, the majority of links making up the footrest and its support system are in a horizontal plane tightly pulled upward under the seat so as to allow the "high-leg" look of the chair and substantial clearance from the floor. The sum of the weights of the links in such a horizontal plane creates a significant downward load. This load must be counteracted to maintain the footrest in the closed, tucked-up position. Because the gas cylinder 106 is most advantageously oriented to produce an upward force, it is advantageous to have a wire extension spring shown in FIGS. 9A-9C cooperate with the gas cylinder 106 to ensure that the links stay in the closed position. The gas cylinder 106 is activated by pulling a cable disposed within housing 356 (see FIG. 3) and the required pull distance to cause activation is small, but the required displacement of the roller pin to push the footrest down from its wire spring biased upward position is relatively large. It is thus advantageous to have a spring connection between the lever 117 and the cable in its housing 356 so that pulling the lever 117 through its full range of motion will not over-extend the cable and damage the gas cylinder. In order to accomplish this and to correctly adjust and locate the cable end which is to be pulled by the lever 117, a system of sliding and adjustable plates may be used, as is described below with reference to FIG. 3.

In accordance with various embodiments of the present invention, the chair may have a reclining backrest 104 that is infinitely adjustable independently of the footrest. An occupant of the chair can sit in an upright position or in any desired position of backward recline, and also can adjust the footrest to any desired position of extension independently of the motion of the backrest. In embodiments of the present invention, the backward recline may be accomplished by the occupant of the chair leaning backward, without the need to use an activation mechanism or to provide extra force such as by pushing down on the armrests with the occupant's arms. A secondary spring-and-link system may be employed to ensure that at all positions of user recline, the user feels only a substantially constant minimal force necessary to recline or move upright to any position. The necessary force may be adjustable via a compression, spring knob and friction plate system, as is described later with reference to FIG. 8.

According to some embodiments of the present invention, the chair is able to achieve substantially 20" footrest projection in a "high-leg" format, meaning that a significant amount of clearance, e.g., substantially 7", is provided between the floor and the apparent bottom edge of the closed footrest. Achieving this configuration requires overcoming significant space limitations. It is preferred that the seat cushion be situated at a comfortable height from the floor to allow for ease of entry and exit to and front the chair, as well as for comfortable sitting with feet on the floor when the footrest is closed. This translates to a limitation of total distance from the floor to the seat cushion. The seat cushion itself occupies a significant portion of this vertical space, and the clearance beneath the chair occupies another significant portion of this vertical space. The collapsed footrest must then be retracted into and stored securely within the remaining space. Embodiments of the present invention have in practice secured the footrest mechanism into spaces at least as small as 4" of vertical clearance. The footrest must then also be able of being extended within the realized vertical limitations, it cannot hit the floor. These configurations are achieved by exemplary embodiments of the present invention, as is described in detail below.

Figure 4:
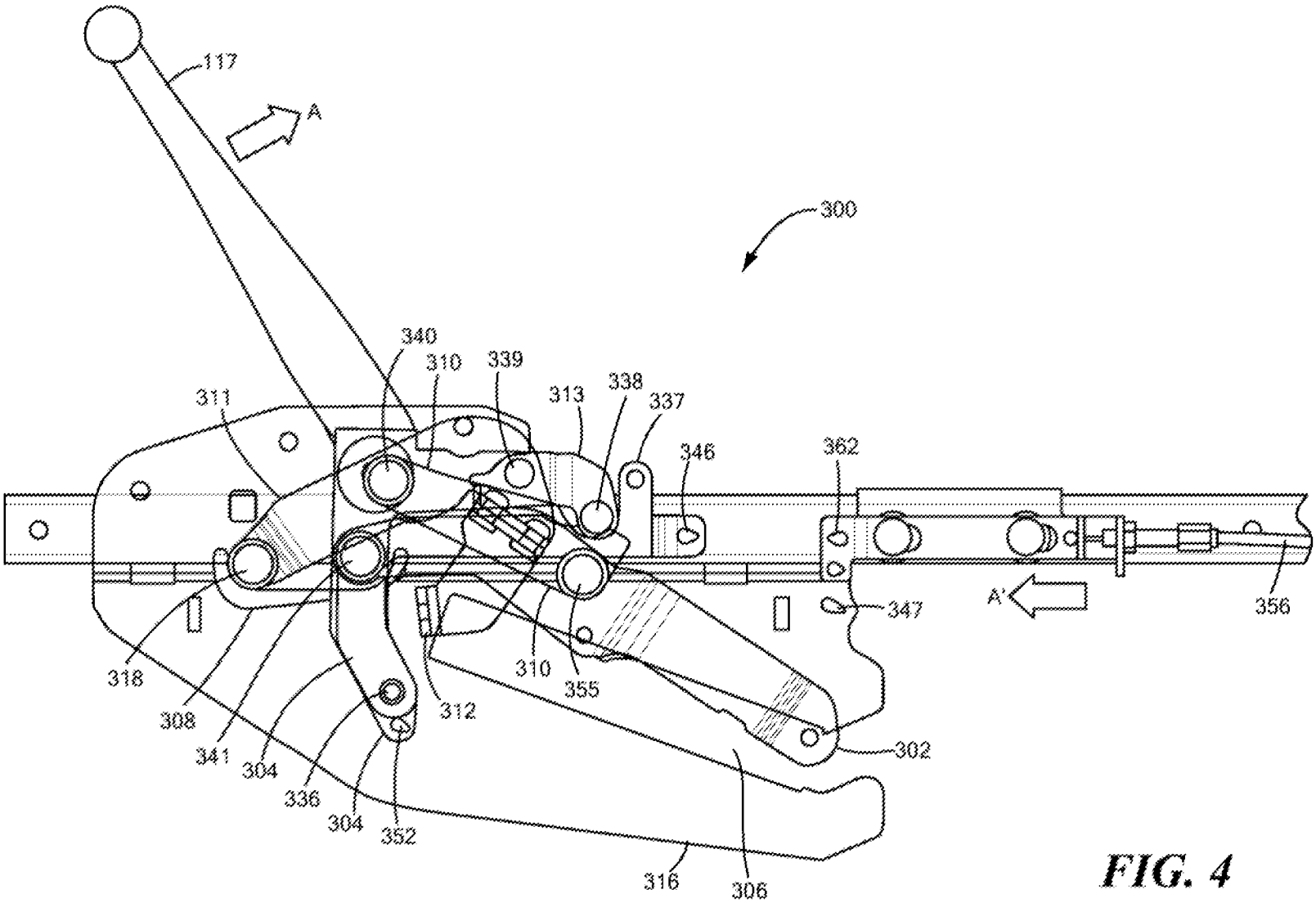

The operation of the footrest assemblies 115 for extending the footrest is now described with reference to FIGS. 3 and 4. Operation of the footrest begins when, while the footrest is in a closed position, a user of the chair, usually an occupant sitting in the chair, actuates a lever 117. The lever 117 rotates clockwise in the direction around point 342 where it is fixed to actuation member 313 and pivotally connected to mounting plate 316. As the lever 117 rotates clockwise, pin 338 comes to press against linkage member 310 in the area of the curved indentation near pivot point 335. This interaction is shown in FIG. 4, which illustrates the mechanism when the footrest is in a closed position. FIG. 3 shows the mechanism when the footrest is in an open position. Linkage member 310 is pivotally connected to rearward mounting arm 302 at pivot point 335, and thus the pressure indirectly applied to linkage member 310 from lever 117 is also transferred to rearward mounting arm 302, which begins to move clockwise around pivot point 340 where it is pivotally connected to linkage member 310. Linkage member 311 is, in turn, pivotally connected to mounting plate 316 at pivot point 318. Linkage members 310 and 311 provide support to the footrest through pivot point 335. The configuration of linkage members 310 and 311 determines the leverage that the footrest has with respect to the gas cylinder. The configuration of leverage of the footrest in relation to the gas cylinder affects the user experience in the compliance of the footrest in use when the gas cylinder is in a locked position. Linkage members 310 and 311 also are used in relation to lever 117 to urge the footrest forward when the lever clockwise is moved to extend the footrest. Slot 347 in mounting plate 316 holds the forward end of spring 122 (shown in FIG. 10A). The other end of spring 122 is connected to slot 706 of the back rest assembly (shown in FIG. 7).

The motion of lever 117 is limited by pin 339, which travels between an upper boundary and a lower boundary of slot 309 (shown in FIG. 5) in mounting plate 316. When pin 339 reaches the lower boundary during extension of the footrest, the footrest continues to extend due to force applied by a gas cylinder 106 and a spring 901 (shown in FIGS. 9A-C). The gas cylinder is connected to crossbar 105 (shown in FIG. 1A) which connects to the end 312 of linkage member 311 and transfers a force from the gas cylinder to the footrest assemblies 115. The spring 901 (not shown) connects points 343 and 334. When the footrest is closed, the spring 901 resists the opening of the footrest assembly and holds the linkages in a tight space. When the footrest is open, the spring also resists closing of the linkage assembly, holding it open.

Figure 5:
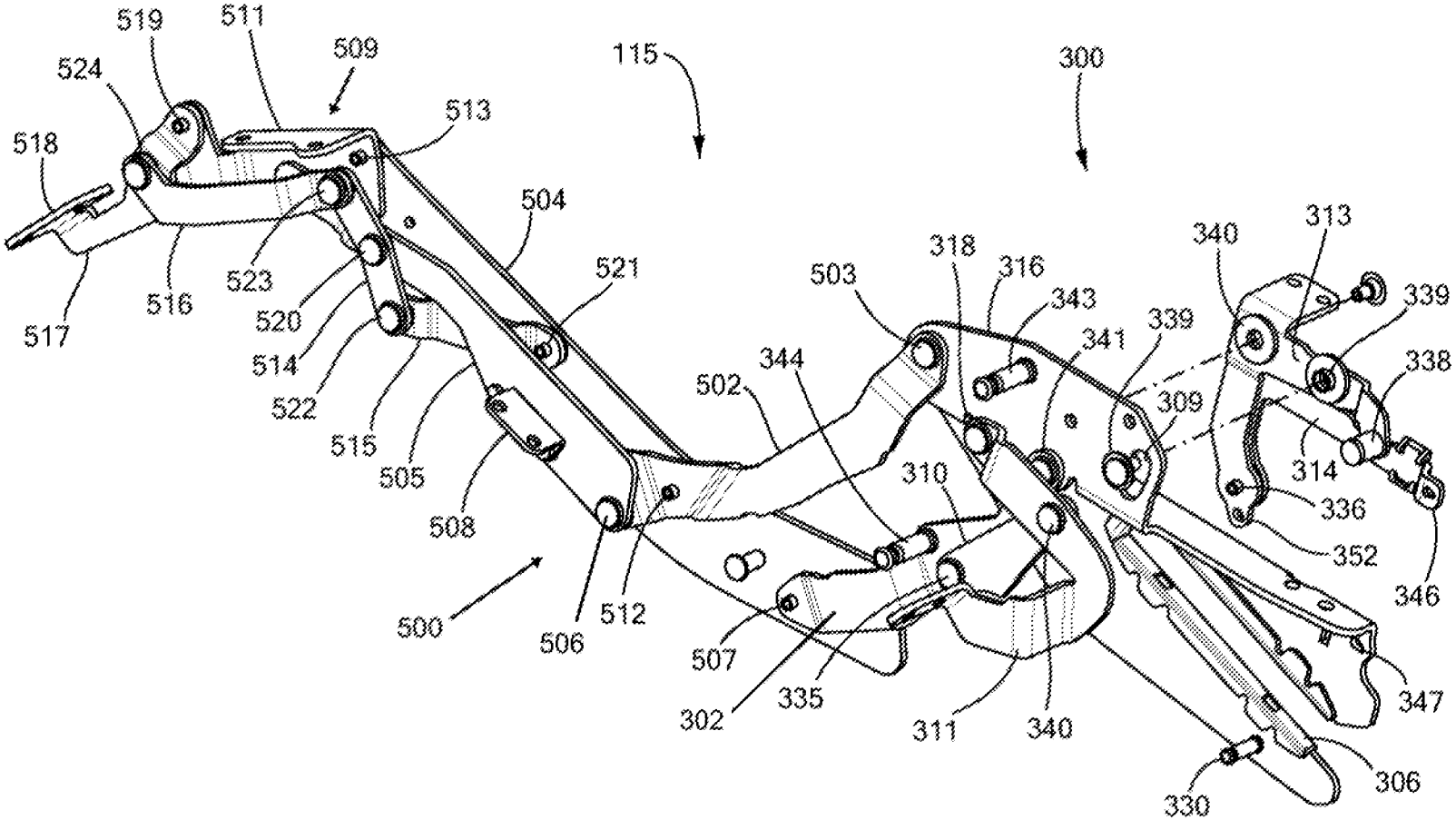
FIG. 5 is an exploded perspective view of the forward collapsible footrest support of the reclining chair embodiment of FIG. 1.

With continued reference to FIGS. 3, 4 and 5, the mechanism for opening the gas cylinder is now described. Actuation member 313 is pivotally connected at pivot point 336 to sliding member 314. As actuation member 313 rotates clockwise, it causes sliding member 314 to slide horizontally to the forward along frame 110*b*. Pin 337 sits on top of frame 110*b* and rides along the top as sliding member 314 slides. Sliding member 314 is connected to sliding member 354 by a spring 121 (shown in FIG. 10A) connected at mount point 346 and mount point 362. Use of the spring 121 causes sliding member 354 to slide based on the distance that sliding member 314 slides, but the distance is proportionally reduced based on the tension of the spring 121. Sliding member 354 pulls on knob 355 when sliding, thereby pulling a cable within a housing 356 with thrust A' thereby opening the valve of the gas cylinder 106. The proportionally reduced sliding distance is advantageous because the cable can only move a relatively short distance without adversely affecting performance of the gas cylinder. However, comfortable operating throw distances of the lever 117 tend to be much larger, and the movement of the lever 117 is simultaneously used to begin pushing the footrest assembly open, which requires a longer throw. Sliding member 354 also includes slots, in which pivots 361 and 360 sit. The length of the slot also is used to prevent the cable from being pulled too far, by blocking travel of the sliding member 354. A handle extension member 304 is connected to sliding member 314 at pivot point 336 and to the lever 117 at pivot point 340. The slot 352 at the bottom of the handle extension member 304 is holding a spring (not Shown) the other end of which is holding on post 330 of mounting plate 316 to bias the handle in the forward position. The handle extension member 304 moves about slot 308 of mounting plate 316.

FIG. 5 is a perspective view of a collapsible footrest assembly used in the chair embodiment shown in FIGS. 1-4 in a semi-deployed position. The footrest assemblies include a pair of extending articulated support arms connected by a plurality of members. The following description of an extending articulated support arm applies equally to both right and left extending articulated support arms, which are mirror images of each other.

The extending articulated support arm 500 includes a bent elongated primary support member 504 which, when the footrest is in an open position, extends from beneath the front of the padded seat along the greater portion of the footrest assembly. The primary support member 504 forms an elbow near its mid-section offset toward the rearward position such that rearward portion is shorter than forward portion in the folded and extended positions of the chair, the rearward portion is substantially parallel to the floor. The forward portion is at an angle θ of between 135° to 165° from the rearward position so that it projects forward and upward in both extended and closed positions. The angle between the two portions permits a compact structure in the closed position under the seat of the chair where the footrest assembly 115 remains substantially elevated from the floor. A series of scissor linkages (e.g., points where two members are pivotally connected to each other), described below, connects the mounting frame 300 to the bent primary support member 504, and further connects to the flipping portions of the footrest support. The vertical dimension of primary support member 504 should be great enough to extend both above the top and below the bottom ridges of the series of linkages disposed facing the interior space of the footrest assemblies 115, so as to mask the assembly in its fully deployed position. Similarly, the length of primary support member 504 is to extend forward and rearward from the footrest panels 102, 103 to the front of the chair. These dimensions however are constrained by the space under the seat of the chair and must not bring the bent primary support member 504 in contact with the floor or the chassis. The bent primary support member 504 is moveably connected to the mounting frame 300 by a forward mounting arm 502 and a rearward mounting arm 302 at pivot points 512 and 507, respectively. The forward mounting arm 502 also is pivotally connected to an extended control member 505 at a pivot point 506. The relative positions of pivotal connection between the forward mounting arm 502, the bent primary support member 504 and the extended control member 505 are such that as the footrest is extended, and the forward mounting arm 502 rotates clockwise relative to the bent primary support member 504 about the pivot point 512, the extended control member 505 advances parallel to the forward portion of the bent primary support member 504 in a direction away from the underside of the reclining chair.

Pivot point 512 joins two parallelograms, a forward parallelogram and a rearward parallelogram. The forward parallelogram has a distinct rectangular shape with its long sides formed by extended control member 505 and the forward portion of bent primary support member 504 and its short sides formed by forward portion of forward mounting arm 502 and forward portion of linkage member 514. The pivot points 512, 520, 506, and 523 form the four corners of the forward rectangular parallelograms. The forward parallelogram when actuated deploys the footrest portions 102 and 103, while maintaining a discreet profile as viewed from the side such that the linkages are easily hidden behind a cover 601 that fits snuggly on bent primary support member 504. The rearward parallelogram has a somewhat less distinct rectangular shape where its four sides have similar although not necessarily equal lengths. The rearward parallelogram thrusts forward the footrest and the bent primary support member 504 from its closed position under the seat to the extended position. In the extended position all its linkages are substantially flushed and hidden from view behind bent primary support member 504. Pivoting points 512, 507, 341 and 503 form the four corners of the rearward parallelogram. The motion of the rearward parallelogram can be biased toward the deployed or retracted position by the use of a spring 901 (shown in FIGS. 9A-C) attached to anchors 343 and 344.

The extended control member 505 is in turn connected to a series of linkages, whereby when the extended control member 505 advances parallel to and longitudinally along the bent primary support member 504, the linkages are activated to deploy the footrest. The extended control member 505 also includes a bracket 508 for mounting a panel 101 in FIG. 1A bridging the right and left footrest assemblies. The panel is mounted onto extended control members on both of the extending support arms and provides structural stability to the assembly. The extended control member 505 is pivotally connected to an intermediate footrest member 509 at a pivot point 510 located at about its midsection. The intermediate footrest member 509 also is pivotally connected to the bent primary support member 504 at a pivot point 513. When the extended control member 505 advances longitudinally and parallel to the bent primary support member 504, it causes the intermediate footrest member 509 to rotate clockwise relative to the bent primary support member 504 and upward into an extended position thereby raising flipper panel 103 (FIG. 1A). The intermediate footrest member 509 also includes a bracket 511 which connects to the main foot rest panel 102 in (FIG. 1A). The panel 102701 is mounted to intermediate footrest members on both of the right and left extending support arms and provides structural stability to the assembly, as well as support to the footrest.

The extended control member 505 form a polygon (5 sides) with bent primary support member 504, its forward portion, which activates deployment and retraction of the footrest panels.

The extended control member 505 connects to linkage member 514 at its midsection at pivot point 520. Linkage member 514 is connected at pivot point 522 to linkage member 515 which connects back to the bent primary support member 504 at pivot point 521. Linkage member 514 also connects at pivot point 523 to linkage member 516 which connects forward to terminal footrest member 517 at pivot point 524. When extended control member 505 advances parallel to the bent primary support member 504, the series of linkage members 515, 514, and 516 all straighten out to positions that are roughly equivalent to collinear. Linkage member 516 advances, causing terminal footrest member 517 to rotate clockwise relative to intermediate footrest member 509 around pivot point 519 connecting intermediate footrest member 509 to terminal footrest member 517. Terminal footrest member 517 also includes a bracket 518 which connects to the flipper panel 103 (FIG. 1A). The flipper panel 103 is mounted to terminal footrest members on both of the extending support arms and provides structural stability to the assemblies, as well as support to the footrest.

Figure 9A:
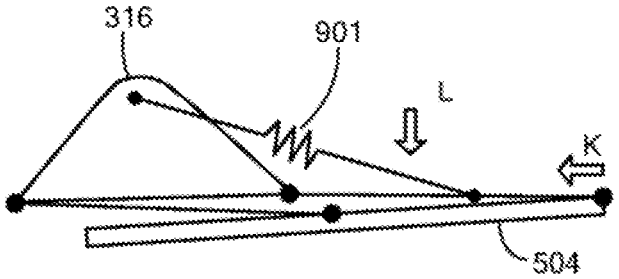
FIGS. 9A-9C are schematics depicting forces applied during operation of a footrest in accordance with an embodiment of the present invention.
Figure 9B:
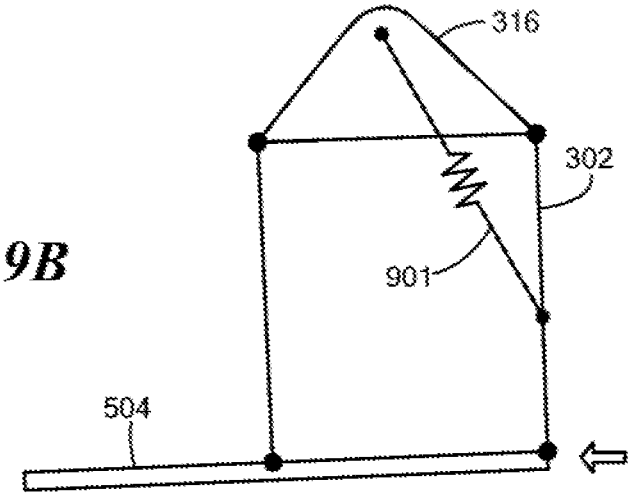
Figure 9C:
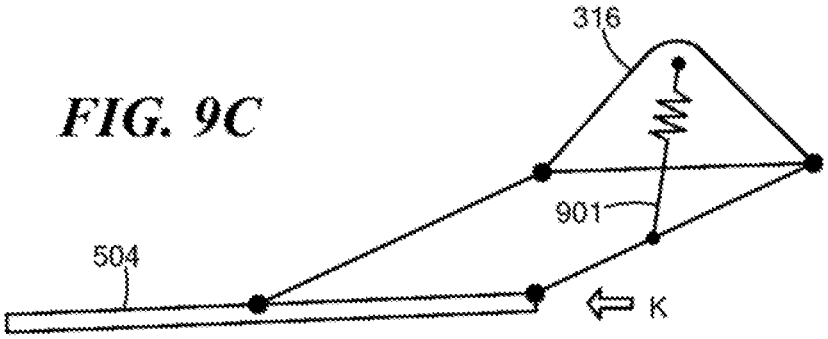

FIGS. 9A, 9B and 9C are schematics Showing in the plane the forces that act on the rearward parallelogram of the footrest mechanism to swing the primary support member 504 from a fully retracted position, shown in FIG. 9A, to an intermediate position, shown in FIG. 9B, and to a partially open position, shown in FIG. 9C. As can be seen in FIG. 9A, a contracted spring 901 holds by tension the primary support member 504 in the fully retracted position flushed against mounting plate 316, until the lever 117 is actuated. The actuation of the lever 117 causes two forces L and K to apply an opening torque on rearward mounting member 302: (i) a first force (indicated by L) is applied from the arm 313 (FIG. 3) rigidly connected to the lever 117 (FIG. 3) through linkage members 310 (FIG. 3) on rearward mounting arm 302; and (ii) the second force (indicated by K) is created by the opening of the valve on the gas cylinder. The combination of these first and second forces overcomes the tension of the spring 901 that had been holding the footrest in the fully retracted position and stretches spring 901. By the time the footrest mechanism reaches the orientation shown in FIG. 9B, the first force is no longer being applied; however, the gas cylinder is still creating a forward thrust opening the footrest mechanism, and the spring's tension is now pulling the footrest mechanism in the forward direction to the open position. The spring and the gas cylinder can continue urging the footrest mechanism into the partially open position shown in FIG. 9C and further until the footrest mechanism is in its fully open position. At any point during this opening process, the lever may be let go to close the valve on the gas cylinder and thereby stop the opening process. In this way, the footrest mechanism may be stopped in a partially open position.

Figure 6:
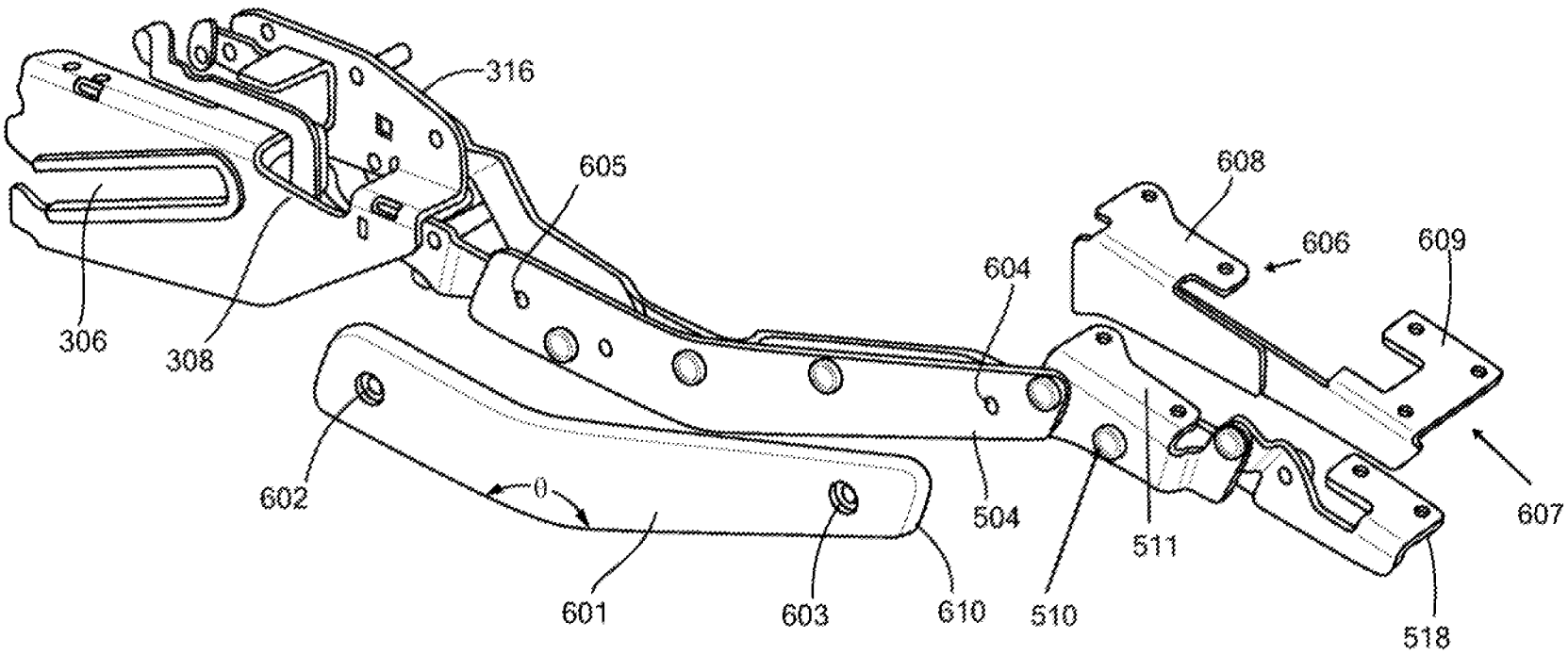
FIG. 6 is an exploded perspective view of the portion of the collapsible footrest support assembly of the FIG. 1 embodiment.

FIG. 6 shows a cover assembly that obscures the linkages of right extending primary support member 504 when the footrest is extended. A bent support member cover 601 attaches to the bent primary support member 504 by bolts connecting bolt hole 602 to bolt hole 605 and connecting bolt hole 603 to bolt hole 604. The bent support member cover 601 includes a lip 610 along the top and bottom sides that envelops the sides of, and snaps on, the bent primary support member 504. An intermediate linkage cover 606 attaches via bracket 608 to bracket 511, and a terminal linkage cover 607 attaches via bracket 609 to bracket 518. When the footrest is fully extended, the appearance to an observer next to the chair is of a single arm with a smooth, clean appearance. The bent support member cover 601, intermediate linkage cover 606 and terminal linkage cover 607 may be composed of stainless steel, wood, or other acceptable materials that are preferably sturdy and attractive, such that the footrest appears to be supported by a single arm, attractively styled and proportioned member. In many footrest assemblies of the prior art, the footrest extension mechanism can be an ugly and dangerous assembly made up of various scissor links and/or pivoting links which are both aesthetically unappealing and pose a pinching and shearing hazard. By developing a footrest support assembly that presents a particularly narrow profile during and at full extension, as described above with respect to FIG. 5, it becomes possible to provide covering members as shown in FIG. 6 that obstructs potential pinch points and presents a more attractive profile.

In one embodiment, the footrest system uses a chaise approach, meaning that, when open, there is the appearance of a continuous padded surface from the seat cushion to the forward edge of the footrest. This involves the use of a pad, which is about 2" thick. The pad may project horizontally forward about 6" and can be seen as a continuation of the seat surface. The pad has an intentional seam and small visual joint or gap after this 6" projection, and the same thickness of pad then continues forward and spans the remaining gap between wood footrest support panels and the front of the seat cushion. The pad continues forward without visual break to the forward edge of the flipper panel. In the closed position, the intentional seam is the visual demarcation between the bottom of the seat cushion and the closed vertical section of the main footrest panel. The 2" pad is the in a close position forming the front face of the seat cushion. The main footrest panel preferably has the pad surface accurately located in a vertical plane and the intentional seam preferably is tensioned and pulled rearwards so as to create a straight and fixed joint between the apparent bottom of the seat cushion and the start of the main footrest. To make the thin pad fixed and aligned, there is a pull strip sewn to the intentional seam which is attached to the middle panel. The relative movement of the middle panel and intentional seam create tension in the pull strip necessary to locate and align the seam and the pad as it covers the front of the seat cushion and the lower main footrest panel. The combination of these elements leads to an attractive footrest and seat cushion in the open position and a conventionally styled appearance of the seat cushion with the footrest below in the closed position.

The operation of the backrest according to an embodiment of the present invention is now described with reference to FIG. 7. The backrest is configured so that an occupant of the chair may recline the backrest by leaning backwards, applying body weight against the backrest activating assembly 700. A bracket 701 is rigidly connected to the interior of the armrest (not shown) of the chair. The armrest remains stationary relative to the base of the chair (107, 108, 109) during operation of either the footrest or the backrest, and thus serves as an anchoring point at bracket 701. A swinging V-shaped member 114 is pivotally connected to bracket 701 at pivot point 704. Swinging member 114 also connects to a backrest member (item 104 in FIG. 1A), which serves as the primary structural member of the backrest. When thrust (shown in FIG. 10E) is applied to backrest 104 and the backrest reclines, a thrust H (shown in FIG. 10E) shifts the swinging member 114, which rotates clockwise around pivot point 704, and the frame 110 of the chair simultaneously slides forward. A plate 703 is pivotally connected to swinging member 114 at pivot point 710. As the backrest reclines, plate 703 rotates counterclockwise around pivot point 710 while resistant friction applied by resistance assembly 711, shown in greater detail in FIG. 8 as viewed from the bottom. The resistance assembly 711 advances through a slot in linkage member 709, which is pivotally connected to linkage member 705 at pivot point 708. When resistance assembly 711 reaches the end of the slot 702 in linkage member 709, linkage member 709 is forced forward causing linkage member 705 to rotate counterclockwise around pivot point 707, where linkage member 705 is pivotally connected to plate 703. When linkage member 705 begins to rotate, a spring 122 (shown in FIG. 10A), connected between mounting holes 706 and 347 (see FIG. 3) is stretched. The stretching of spring 122 provides additional resistance against the reclining action of the backrest, which begins to be applied only after the backrest is partially reclined to a sufficient degree that the resistance assembly 711 has slid through the slot in linkage member 709. This configuration is advantageous because as an occupant of the chair reclines, the rotational force provided by the occupant's body weight increases. In a configuration of constant resistance, this can lead to a sudden jerking motion in the middle of the reclining motion, which may be unsettling to the occupant. By increasing the resistance in the middle of the reclining motion, a smoother motion can be achieved. Furthermore, raising the backrest from a reclined position requires overcoming the friction in the resistance assembly. At least some of the necessary force can be provided by the occupant of the chair shifting the occupant's weight on the seat and bottom backrest. In addition, however, the spring that regulates resistance during the reclining motion may also provide some assistance in raising the backrest between the fully reclined and partially reclined positions, by delivering the same tension that resists lowering the backrest in the latter portion of the reclining motion.

Resistance assembly 711 is now described in greater detail with reference to FIG. 8. Resistance assembly 711 comprises a screw 801 terminated at both ends by nuts 808. Adjustment knob 803 mounted on screw 801 may be used to reduce or increase the distance between adjustment knob 803 and resistance member 804, which respectively increases or decreases the tension applied to spring 802. Washer 806 is inserted between knob 803 and spring 802 to provide support to knob 803. Compression of spring 802 between knob 803 and resistance member 804 is translated into a pressure of resistance against resistance member 804 against resistance layer 807. The resistance member 804 passes through a slot in linkage member 709 and does not come into frictional contact with linkage member 709, allowing the resistance assembly to slide freely relative to linkage member 709 until the end of the slot is reached. The resistance member 804 also passes through a slot in resistance layer 807. Resistance member 804 causes a pair of washers 805, one on either side of resistance layer 807, to come into firm contact with resistance layer 807, forming a tight compression between resistance member 804, the first washer 805, resistance layer 807, and plate 703. Adjustment knob 803 thus governs the resistance between resistance layer 807 and washers 805.

Figure 10A:
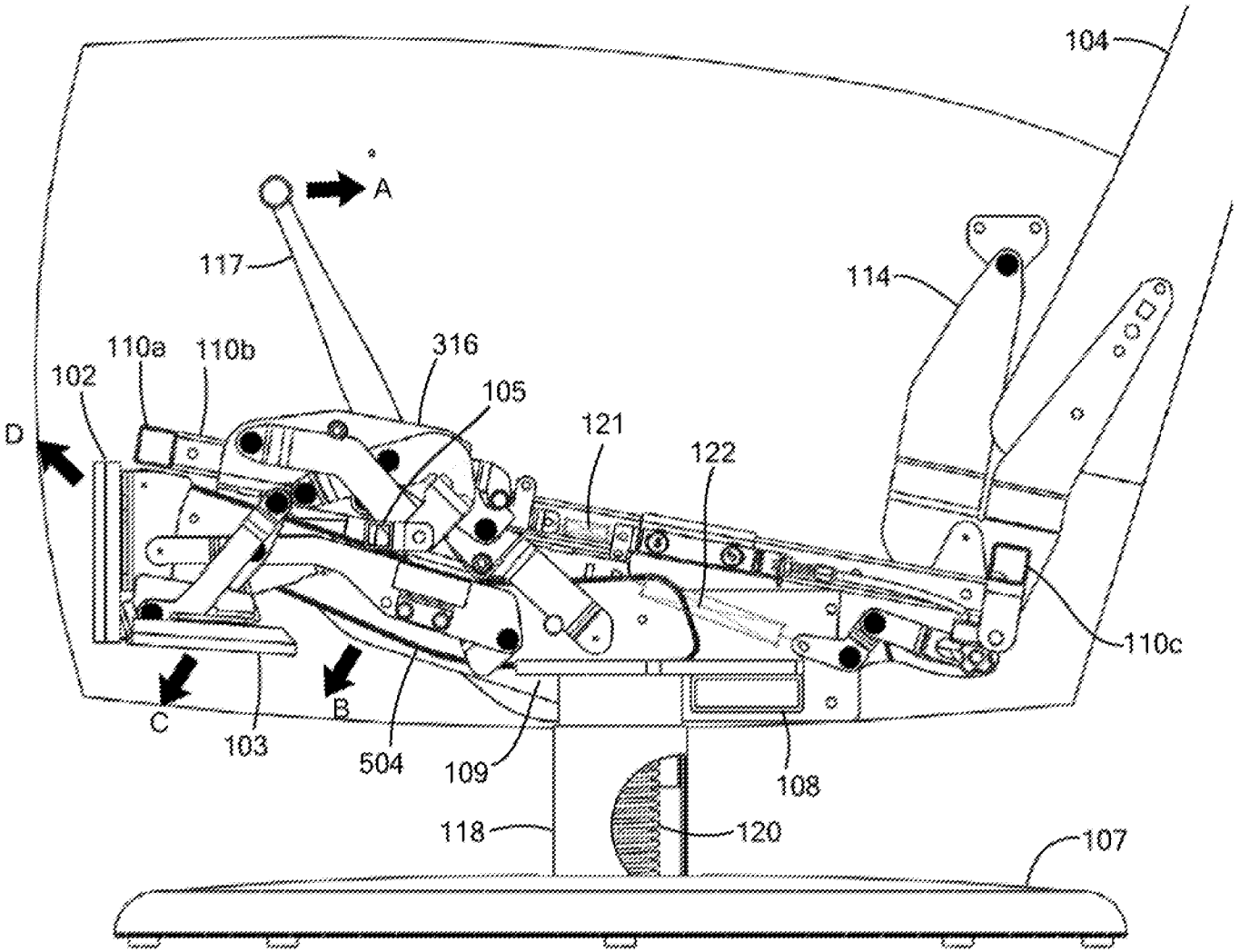
FIGS. 10A-10I are side views of the reclining chair and internal components of the FIG. 1 embodiment, with each of these figures representing the reclining chair in a different position.
Figure 10B:
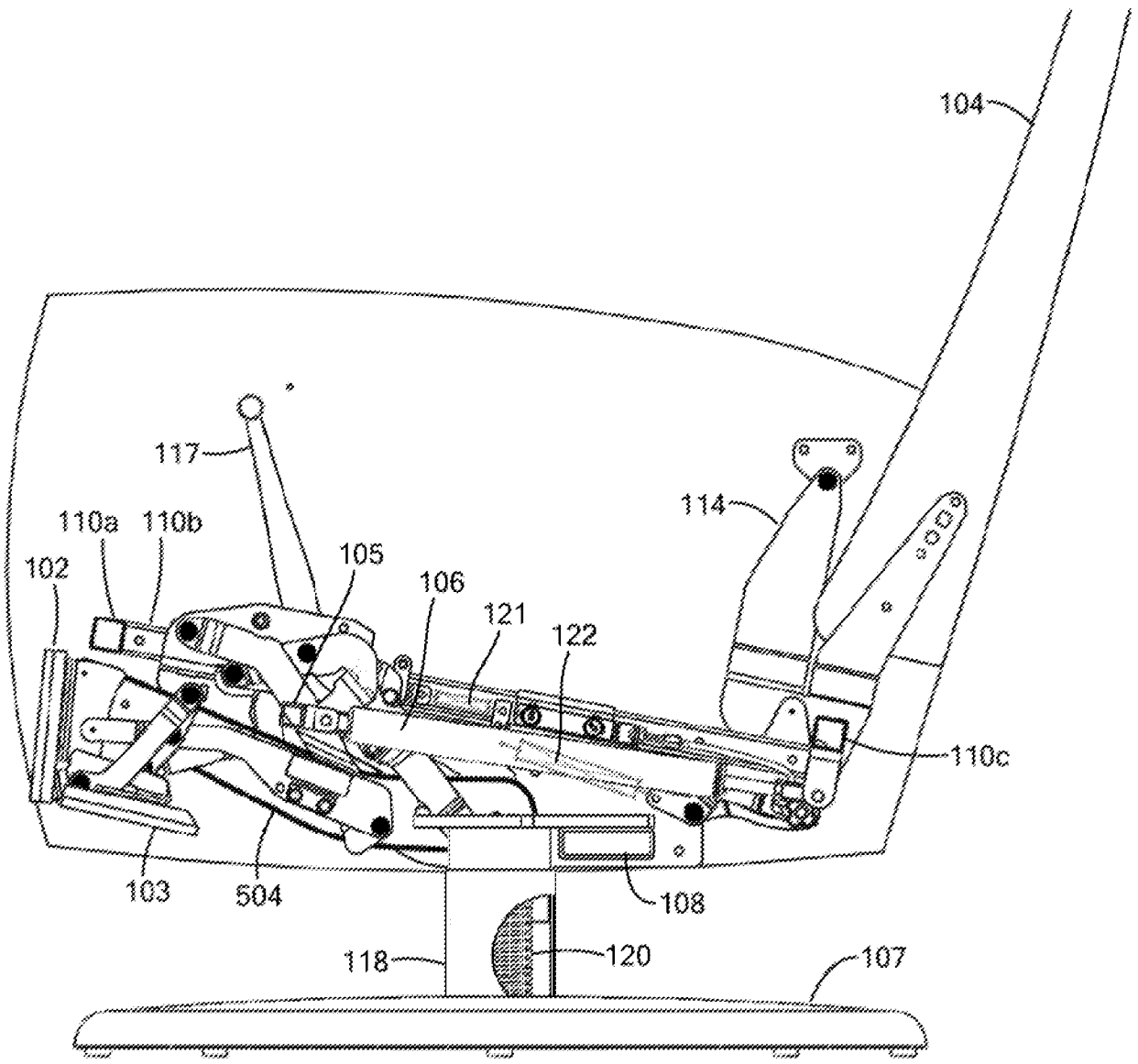
Figure 10C:
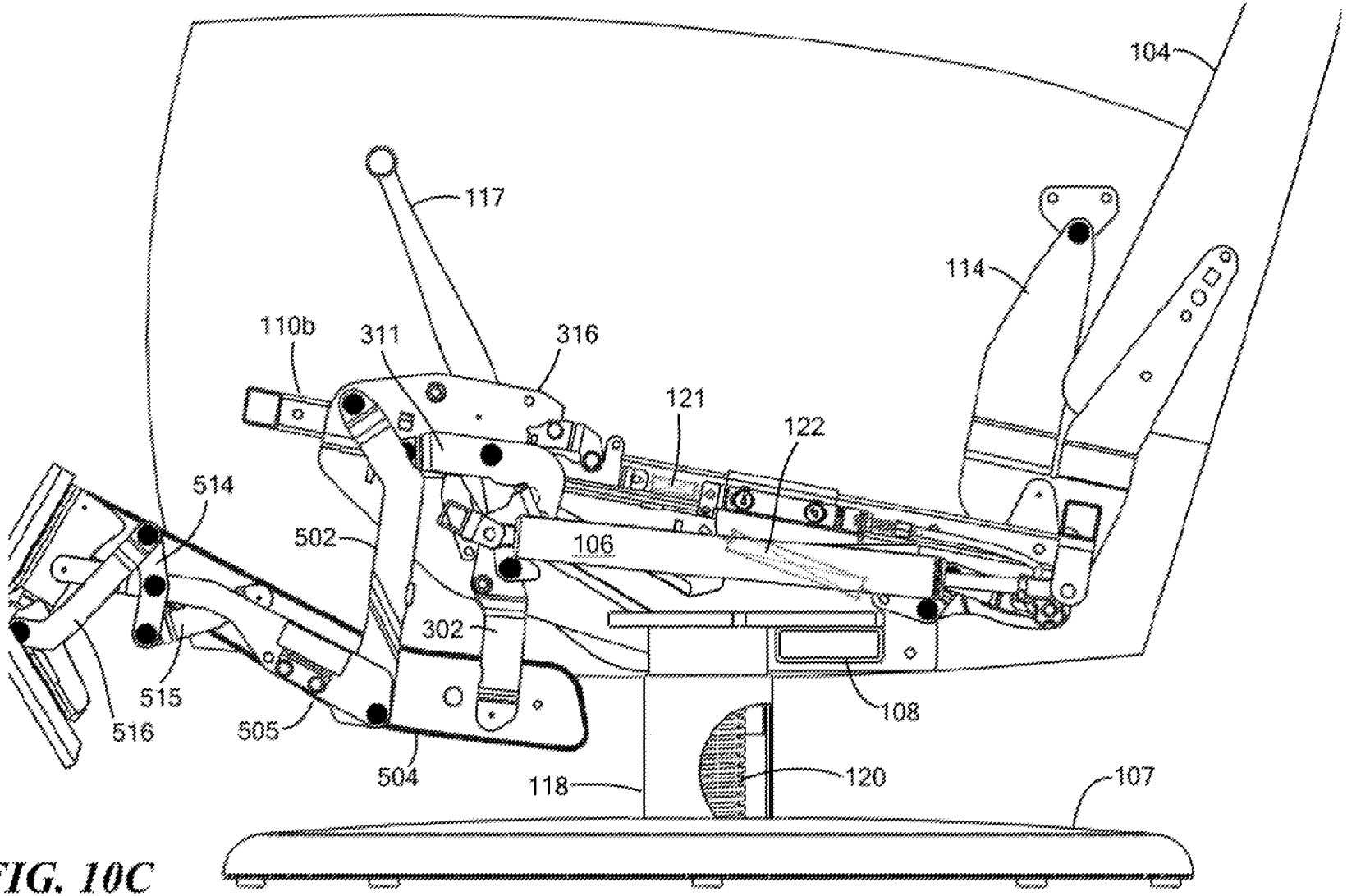
Figure 10D:
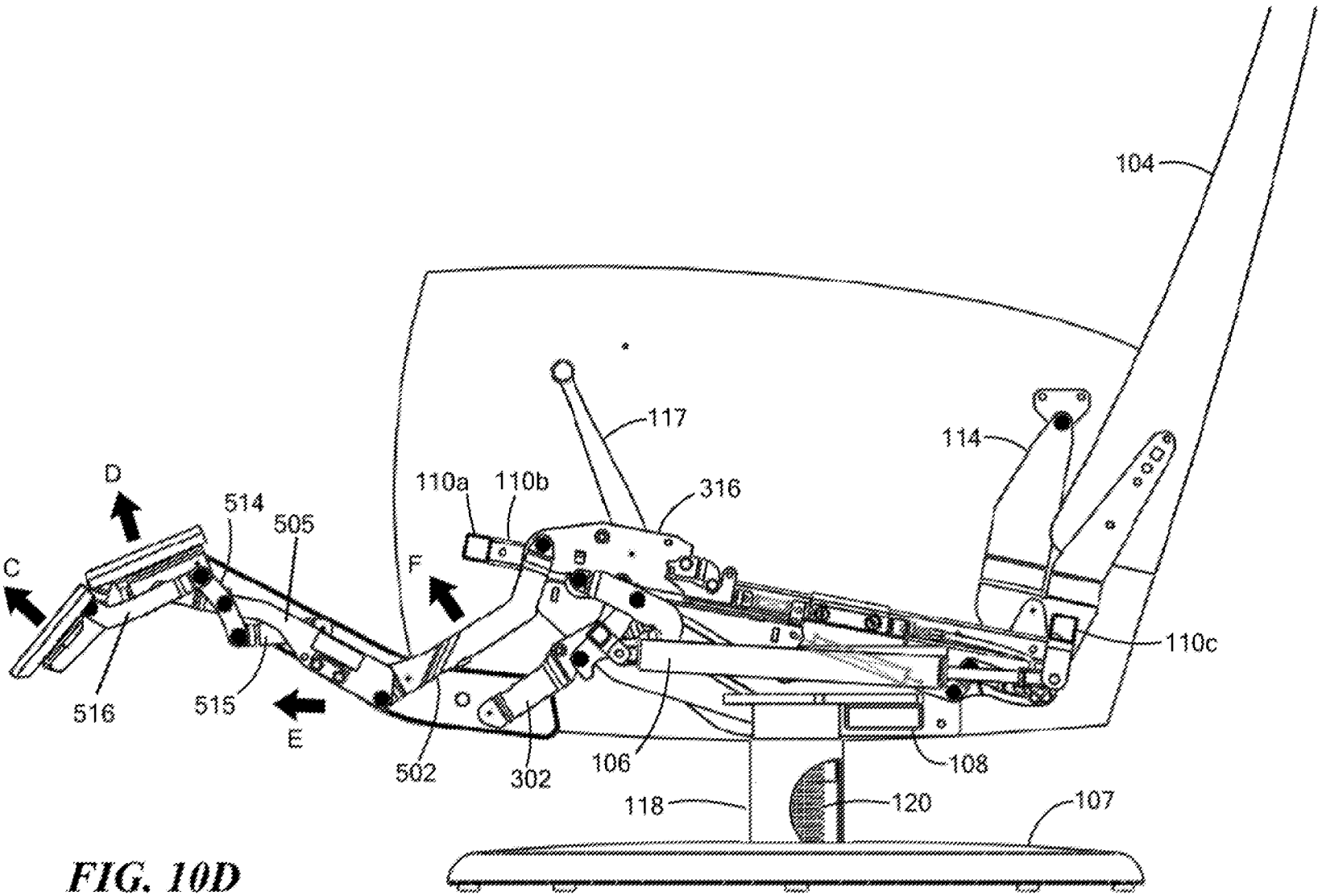
Figure 10E:
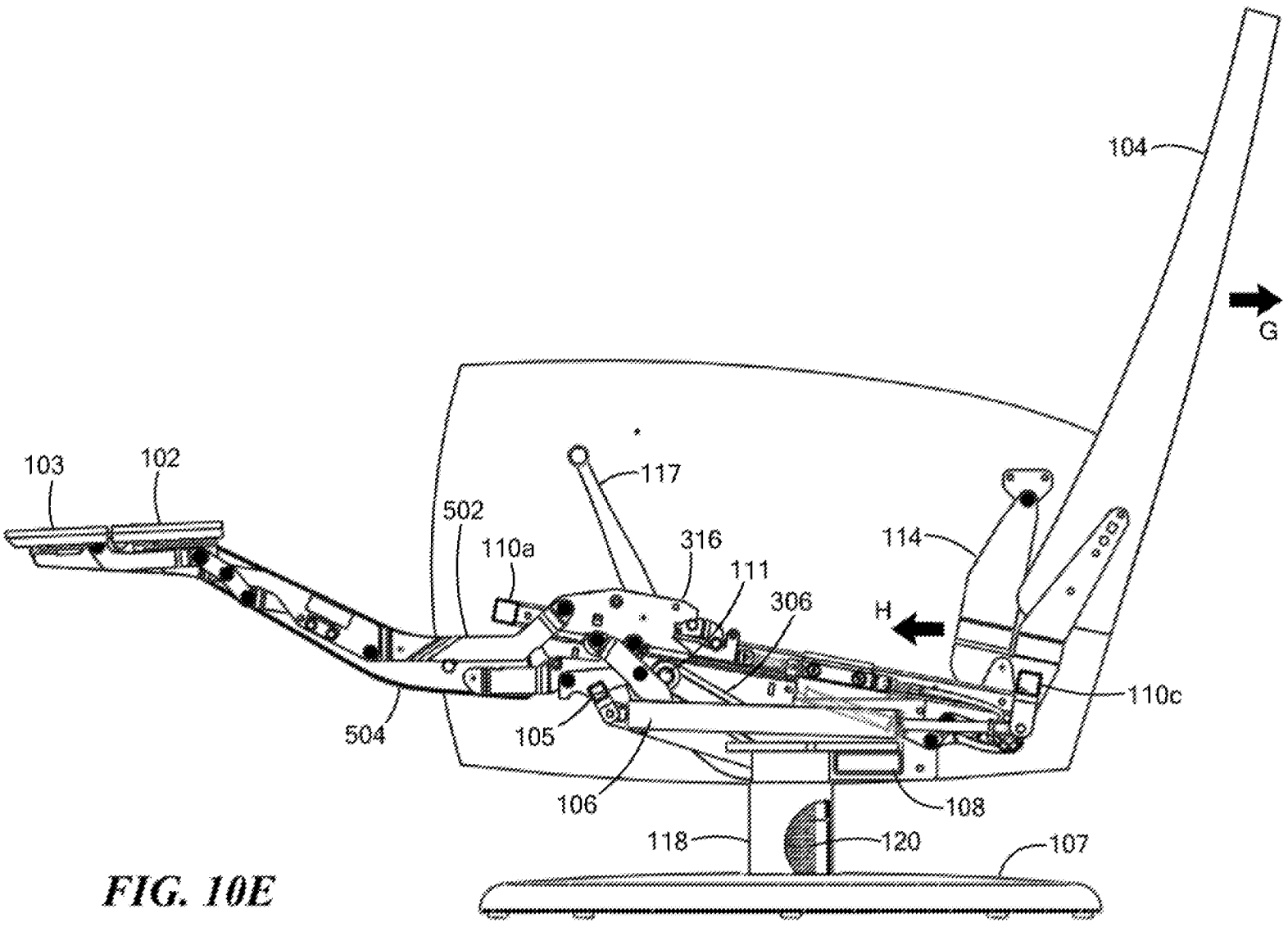
Figure 10F:
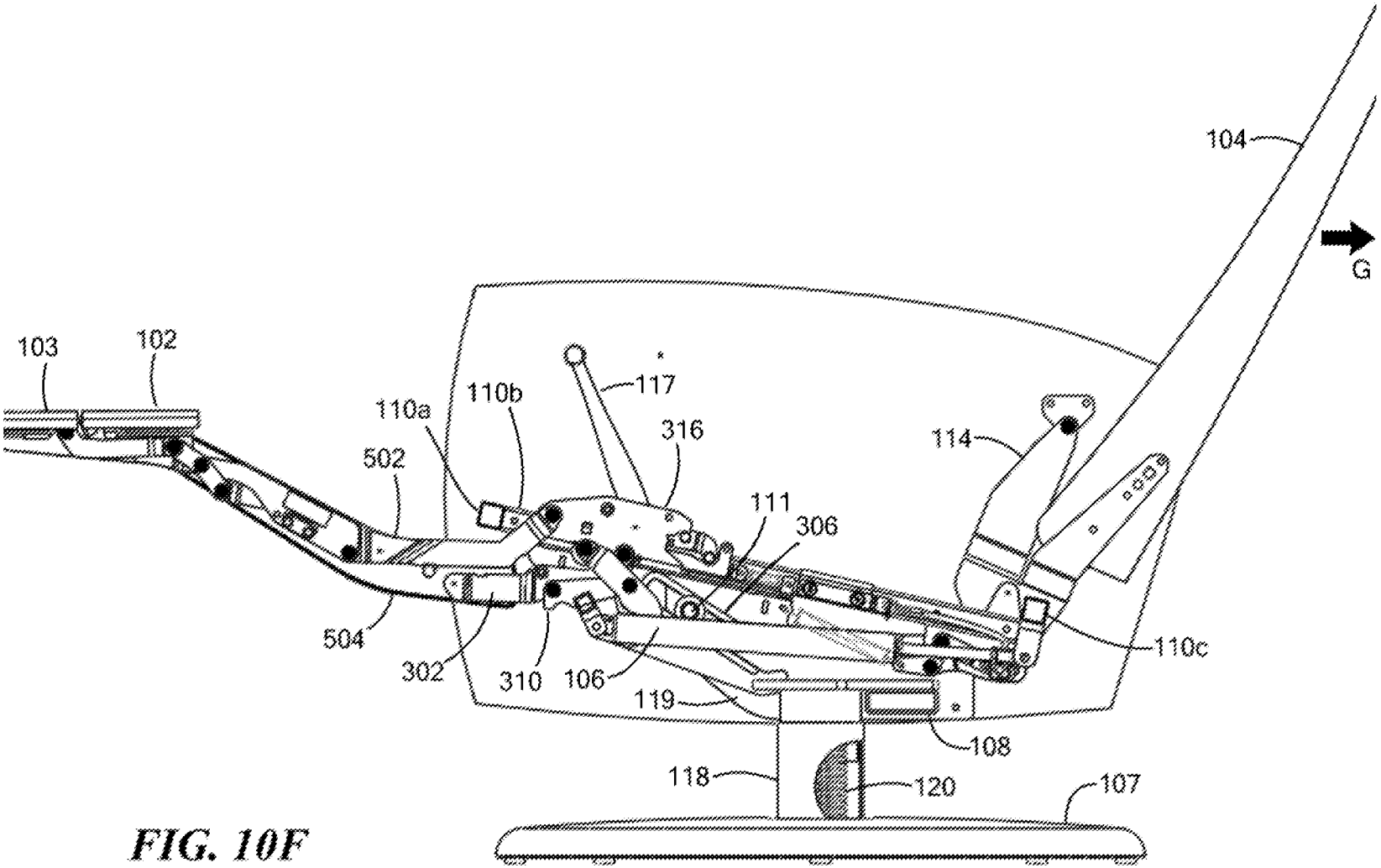
Figure 10G:
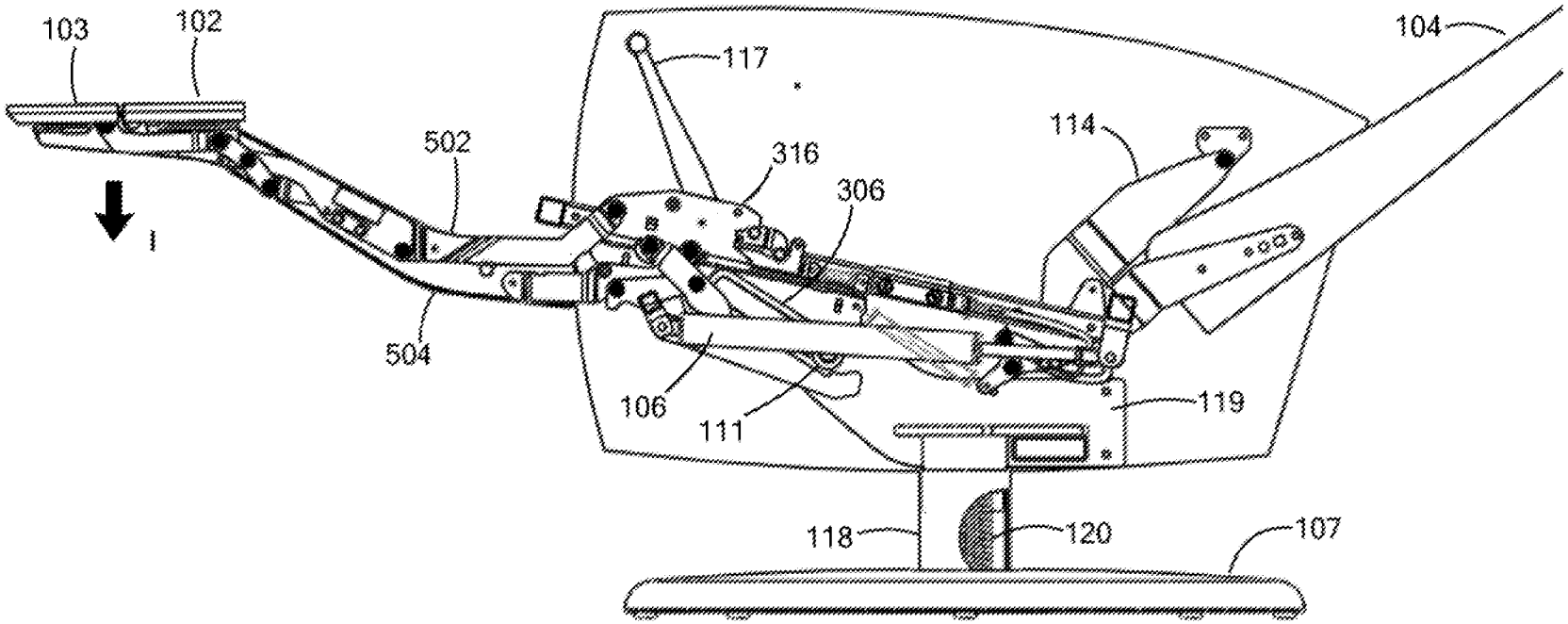
Figure 10H:
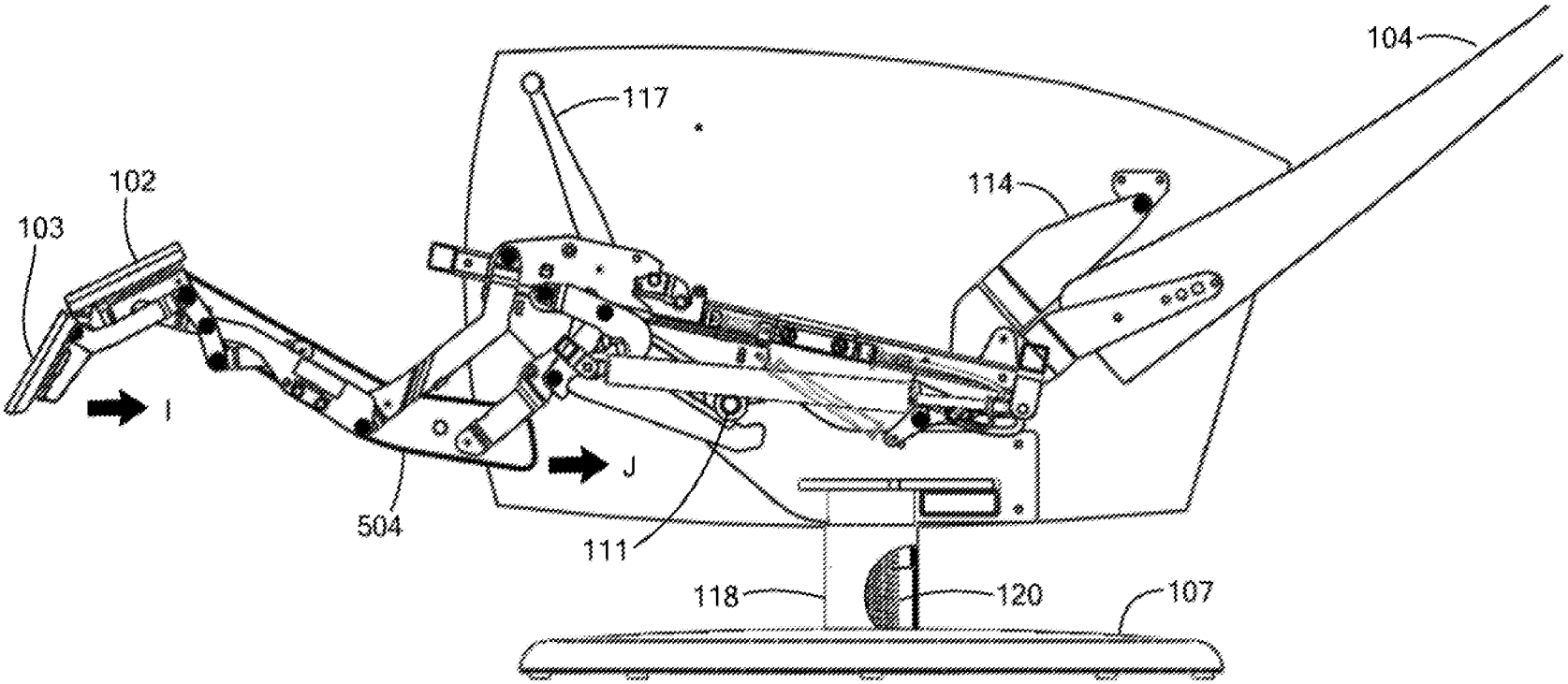
Figure 10I:
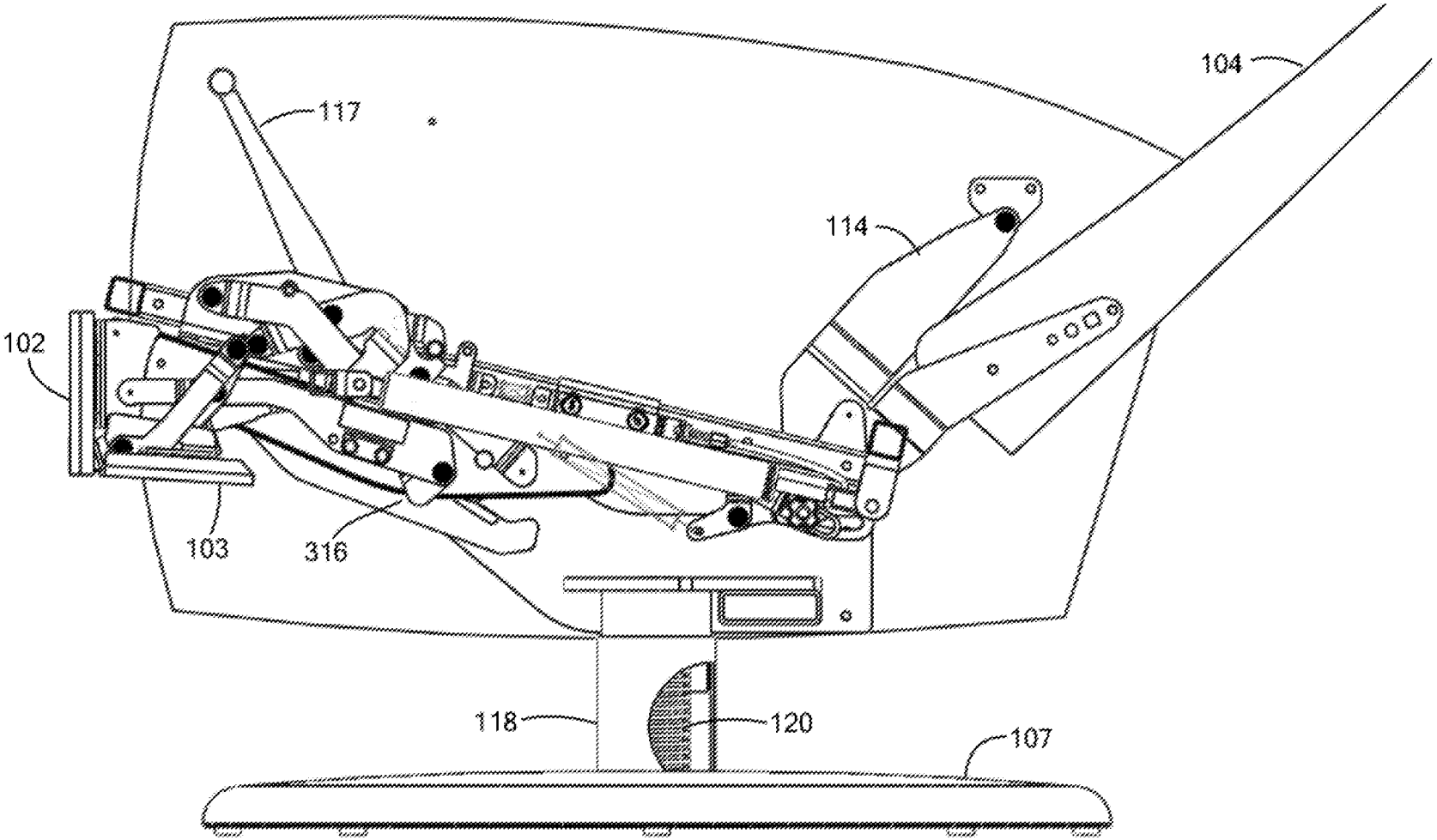

FIG. 10A-1 are side views of the reclining chair and its internal components. FIGS. 10A to 10E show the footrest mechanism progressing from a fully closed position to a fully open position. FIGS. 10F to 10I show the backrest at different amounts of inclination. FIG. 10H shows the backrest fully reclined and the footrest partially open. FIG. 10I shows the backrest partially reclined and the footrest fully closed.

Figure 11:
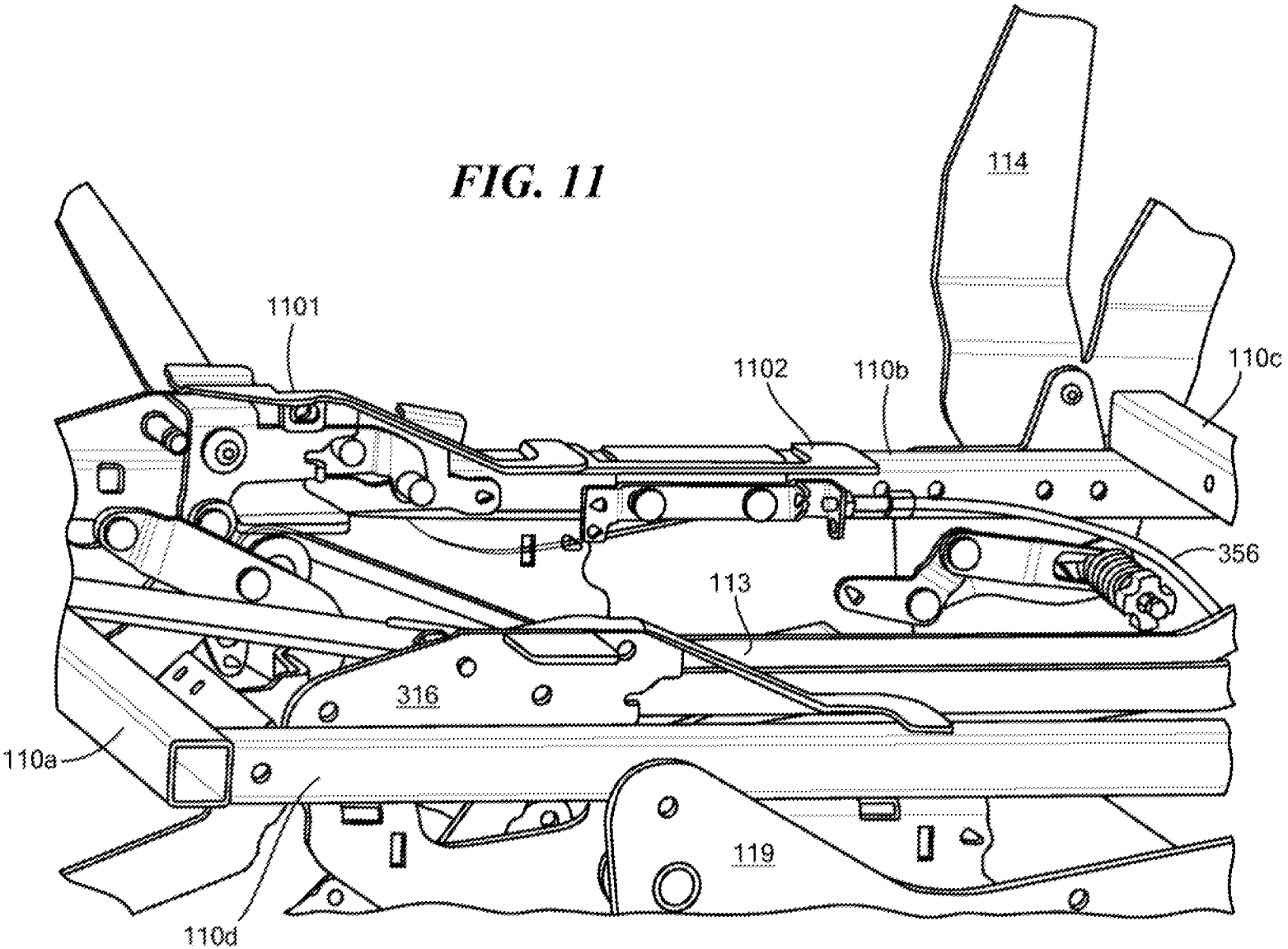
FIG. 11 is a partial perspective view of components under the seat of the chair of the FIG. 1 embodiment.

Referring to 10A, the thrust A applied to lever 117 through the series of linkages described in reference to FIGS. 3-5 ultimately transfers a downward and forward force B onto elongated support member 504, downward and forward force C on flipper panel 103, and an upward force D on main footrest panel 102. FIGS. 10B and 10C show how elongated support member 504 has shifted down and forward in relation to the stationary base assembly thrilled by rotating base 109, pivoting post 118 chassis 108 and base 107. FIG. 10D shows how the thrust created by gas cylinder 106 on crossbar 105 transfers to a forward force E on elongated support member 504, and how upward force C through the linkages of the footrest assemblies 115. FIG. 10E shows the backward force G applied by the chair occupant on backrest 104 and forward motion H on the base of swinging member 114. The action of these two forces concommitaintly thrust the back panel 104 in a reclined position and the seat base frame 110 forward in relation to the stationary base assembly and armrests. Referring to FIGS. 10E to 10G, the forward motion of the frame 110, forces stationary knob 111 mounted on stationary arm rest on sidewall 119 to travel in slot 306 of mounting plate 316 thrusting the frame 110 forward and up. Referring to FIGS. 10G and 10H, a downward thrust applied with the feet of the chair occupant creates a downward force I, which engages the linkages of the footrest assemblies 115 into a reverse direction and transfers the initial force I into backward forces I and J. FIG. 10I shows the footrest completely retracted while the seat remains forward and elevated in relation to the stationary base and the back rest is reclined. FIG. 11 shows the seat assembly with frame components 110*a-d*, 113 and brackets 1101 and 1102 for protecting the moving parts of the handle assembly from the upholstery.

The embodiments of the invention described above are intended to be merely exemplary; numerous variations and modifications will be apparent to those skilled in the art. All such variations and modifications are intended to be within the scope of the present invention as defined in any appended claims.

The invention claimed is:

1. A seat comprising:

a seat portion having a front, a rear, and sides;

a backrest extending from the seat portion at an angle, wherein the angle of the backrest is adjustable;

a friction plate located adjacent a pivot point for the backrest;

a resistance assembly comprising:

a compression spring adjacent the friction plate; and a knob adjacent the compression spring, wherein the knob may be adjusted to change an amount of force required to change an angle of the backrest; and an extension spring connected to the backrest, wherein the extension spring is neutral when the angle of the backrest is between an upright position and an intermediate position, wherein the extension spring provides resistance to movement of the backrest toward a fully reclined position when the angle of the backrest is between the intermediate position and the fully reclined position.

2. The seat according to claim 1, further comprising a linkage member connected to the backrest, wherein the linkage member limits motion of the resistance assembly relative to the friction plate between a first position and a second position, and wherein the resistance assembly is in the first position when the backrest is in the upright position, wherein the resistance assembly travels to the second position when the backrest moves from the upright position to the intermediate position.

3. The seat according to claim 1, further comprising a linkage member connected to the backrest, wherein the linkage member selectively engages the extension spring so as to extend the spring only during a select portion of the recline movement of the chair, wherein the extension spring is in the first position when the backrest is in the upright position, and wherein the extension spring is extended during a limited portion of the angular recline of the backrest.

4. The seat according to claim 1, wherein the backrest is configured to experience a first level of resistance to reclining motion between the upright position and the intermediate position and to experience a second level of resistance to reclining motion between the intermediate position and the fully reclined position, the second level of resistance being greater than the first level of resistance.

5. The seat according to claim 4, wherein the second level of resistance is provided by the resistance assembly and the extension spring.

6. The seat according to claim 4, wherein the first level of resistance is provided by the resistance assembly.

7. The seat according to claim 6, wherein the resistance assembly includes a knob configured to adjust the first level of resistance.

8. A seat comprising:

a seat portion having a front, a rear, and sides;

a backrest extending from the seat portion at an angle, wherein the angle of the backrest is adjustable;

a friction plate located adjacent a pivot point for the backrest;

a resistance assembly;

an extension spring connected to the backrest, wherein the extension spring is neutral when the angle of the backrest is between an upright position and an intermediate position, wherein the extension spring provides resistance to movement of the backrest toward a fully reclined position when the angle of the backrest is between the intermediate position and the fully reclined position; and a linkage member connected to the backrest, wherein the linkage member limits motion of the resistance assembly relative to the friction plate between a first position and a second position, and wherein the resistance assembly is in the first position when the backrest is in the upright position, wherein the resistance assembly travels to the second position when the backrest moves from the upright position to the intermediate position.

9. A seat comprising:

a seat portion having a front, a rear, and sides;

a backrest extending from the seat portion at an angle, wherein the angle of the backrest is adjustable;

a friction plate located adjacent a pivot point for the backrest;

a resistance assembly;

an extension spring connected to the backrest, wherein the extension spring is neutral when the angle of the backrest is between an upright position and an intermediate position, wherein the extension spring provides resistance to movement of the backrest toward a fully reclined position when the angle of the backrest is between the intermediate position and the fully reclined position; and a linkage member connected to the backrest, wherein the linkage member selectively engages the extension spring so as to extend the spring only during a select portion of the recline movement of the chair, wherein the extension spring is in the first position when the backrest is in the upright position, and wherein the extension spring is extended during a limited portion of the angular recline of the backrest.

10. A seat comprising:

a stationary frame having:

a stationary base;

a post resting on the stationary base; and a base plate fixedly mounted on a top end of the post, such that the base plate is pivotable with respect to the stationary base;

a chassis fixedly mounted to the base plate and to a right arm rest mounting frame and a left arm rest mounting frame;

a knob located near a front portion of the right arm rest mounting frame or the left arm rest mounting frame;

a backrest plate;

an anchor located near a back portion, the knob slidable within a slot defined in a mounting plate, the anchor movably supporting the backrest plate;

a backrest connected to the backrest plate;

a footrest assembly; and a seat frame movably connected to the footrest assembly and the backrest, the seat frame being suspended in relation to the stationary frame, to the knobs, and to the anchors, wherein the deployment of the footrest assembly from a closed position to an extended position is independent of the reclining of the backrest from an upright position to a reclined position, and wherein the seat frame along with the footrest assembly moves upward and forward when the backrest is reclined.

11. The seat according to claim 10, further comprising an extension spring connected to the backrest plate, the extension spring being neutral when the angle of the backrest is between the upright position and an intermediate position, wherein the extension spring provides resistance to movement of the backrest toward a fully reclined position when the angle of the backrest is between the intermediate position and the fully reclined position.

12. The seat according to claim 11, further comprising a friction plate located adjacent a pivot point for the backrest.

13. The seat according to claim 12, further comprising a resistance assembly including:

a compression spring adjacent the friction plate; and a second knob adjacent the compression spring, wherein the second knob may be adjusted to change an amount of force required to change the angle of the backrest.

14. The seat according to claim 13, further comprising a linkage member connected to the backrest, wherein the linkage member limits motion of the resistance assembly relative to the friction plate between a first position and a second position, and wherein the resistance assembly is in the first position when the backrest is in the upright position, wherein the resistance assembly travels to the second position when the backrest moves from the upright position to the intermediate position.

15. The seat according to claim 13, further comprising a linkage member connected to the backrest, wherein the linkage member selectively engages the extension spring so as to extend the spring only during a select portion of the recline movement of the seat, wherein the extension spring is in the first position when the backrest is in the upright position, and wherein the extension spring is extended during a limited portion of the angular recline of the backrest.

16. Furniture comprising:

a reclinable backrest infinitely adjustable between an upright position and a fully reclined position actuated by a user leaning back, wherein the backrest experiences a first level of resistance to reclining motion between the upright position and an intermediate position and a second level of resistance to reclining motion between the intermediate position and the fully reclined position, the second level of resistance being greater than the first level of resistance, wherein the second level of resistance is created by the first level of resistance provided by a resistance assembly plus additional resistance provided by an extension spring that is stretched as the backrest reclines from the intermediate position toward the fully reclined position.

17. The furniture according to claim 16, further comprising a footrest configured to extend independent of the backrest.

18. The furniture according to claim 16, wherein the resistance assembly comprises a compression spring creating friction in opposition to translational motion.

19. The furniture according to claim 18, wherein the resistance assembly further comprises a knob for adjusting the first level of resistance by adjusting the load on the compression spring.

* * * * *